US005973447A

United States Patent [19]

Mahoney et al.

[11] Patent Number: 5,973,447

[45] Date of Patent: Oct. 26, 1999

[54] GRIDLESS ION SOURCE FOR THE VACUUM PROCESSING OF MATERIALS

[75] Inventors: Leonard Joseph Mahoney; Brian Kenneth Daniels, both of Allentown; Rudolph Hugo Petrmichl, Center Valley; Florian Joseph Fodor, Northampton; Ray Hays Venable, III, Allentown, all of Pa.

[73] Assignee: Monsanto Company, St. Louis, Mo.

[21] Appl. No.: 08/901,036

[22] Filed: Jul. 25, 1997

[51] Int. Cl.[6] ..... H01J 1/52

[52] U.S. Cl. ..... 313/359.1; 313/363.1; 313/362.1; 315/231.31

[58] Field of Search ..... 313/359.1, 363.1, 313/154, 161, 231.01; 60/202; 315/111.81, 111.91

[56] References Cited

U.S. PATENT DOCUMENTS

| | | |
|---|---|---|
| 3,735,591 | 5/1973 | Burkhart . |
| 4,541,890 | 9/1985 | Cuomo et al. . |
| 4,862,032 | 8/1989 | Kaufman et al. . |
| 5,475,354 | 12/1995 | Valentian et al. . |
| 5,508,368 | 4/1996 | Knapp et al. . |
| 5,646,476 | 7/1997 | Aston . |

FOREIGN PATENT DOCUMENTS 1-287819 11/1989 Japan .

OTHER PUBLICATIONS

H.R. Kaufman, Technology of Closed–Drift Thrusters, AIAA Journal vol. 3, pp. 78–87 (1983).

Chuzhko, et al., Diamond and Related Materials, vol. 1, pp. 332–333 (1992). Diamond–like films deposition by magnetron sputtering with additional ionization.

Fedoseev, et al., Diamond and Related Materials, vol. 4, pp. 314–317 (1995). Deposition of –C:H films in a Hall accelerator plasma.

Okada, et al., Japanese Journal Applied Physics, vol. 31, pp. 1845–1854 (1992). Application of a Hall Accelerator to Diamondlike Carbon Film Coatings.

*Primary Examiner*—Nimeshkumar D. Patel
*Assistant Examiner*—Joseph Williams
*Attorney, Agent, or Firm*—Coudert Brothers

[57] ABSTRACT

Plasma beam apparatus and method for the purpose of vacuum processing temperature sensitive materials at high discharge power and high processing rates. A gridless, closed or non-closed Hall-Current ion source is described which features a unique fluid-cooled anode with a shadowed gap through which ion source feed gases are introduced while depositing feed gases are injected into the plasma beam. The shadowed gap provides a well maintained, electrically active area at the anode surface which stays relatively free of non-conductive deposits. The anode discharge region is insulatively sealed to prevent discharges from migrating into the interior of the ion source. Thin vacuum gaps are also used between anode and non-anode components in order to preserve electrical isolation of the anode when depositing conductive coatings. The magnetic field of the Hall-Current ion source is produced by an electromagnet driven either by the discharge current or a periodically alternating current.

64 Claims, 14 Drawing Sheets

GRIDLESS ION SOURCE FOR THE VACUUM PROCESSING OF MATERIALS

FIELD OF THE INVENTION

This invention relates to a gridless ion source apparatus and a method for high current density ion beam processing of materials including surface modification and deposition of coatings onto substrates. The robust ion source is particularly useful in the deposition of non-conductive coatings onto thermally sensitive substrates at high deposition rates.

BACKGROUND OF THE INVENTION

Many ion sources, which had been designed for space propulsion applications, have been applied to material processing. Gridded ion sources, which make use of electrostatic ion acceleration optics (grids) to accelerate ions from a low pressure gas discharge, have been routinely used for ion sputtering, ion implantation, surface modification, dual ion-beam sputter deposition and ion-beam-assisted-deposition techniques to form thin films and coatings. Numerous gridded ion sources have been devised, each with its own particular means of producing or heating electrons to form a low pressure gas discharge and means of producing an ion beam by electrostatic acceleration optics. Some examples of means for electron production and heating include the use of hot filaments, high-field electron emission, RF capacitive heating, RF inductive heating, and microwave electron cyclotron resonant RF heating. Once a gas discharge is formed, the ion beam is extracted and accelerated to select energies by an electrostatic grid or system of electrostatic grids. Downstream of the ion acceleration optics, a secondary electron source is often used to neutralize the space-charge of the ion beam in order to reduce beam divergence and surface charging of targets or workpieces.

In some processes, high ion beam current densities (>1 $mA/cm^2$) are desired for rapid treatment or deposition rates. To achieve rapid processing rates, particularly over large areas, very high total beam currents and current densities with a broad area ion beam are required. Many advances have been made in forming relatively high charge-particle densities within the ion source ($10^{11}$ to $10^{12}/cm^3$) in order to support a high beam current flux density from an ion acceleration optic means. At charged-particle densities greater than $10^{11}/cm^3$, however, there are certain limits of the ion acceleration grids that restrict the ion current density and total ion beam current which may be continuously extracted from the ion source and accelerated. Since the electrostatic lens action of an ion acceleration optic system virtually excludes electrons, there are inherent space-charge limits to the ion beam current density extracted by grid optics. Also, the total ion beam current throughput is restricted by thermal and mechanical limitations of ion acceleration grids. In sputtering and depositing environments, grids can become coated with either conductive or insulating coatings. Gridded ion beam sources used in such applications are prone to fail either through short circuits or dielectric shielding as a result of the spurious coatings. Grids will erode in time due to direct ion sputtering. As such, conventional ion beam grids deteriorate over time, introduce contaminants, and add considerable maintenance and reliability costs when used in many material processing applications.

To overcome the limitations imposed by ion acceleration grids, several workers have developed gridless DC ion sources. In these DC or pulsed-DC devices, ions are accelerated from a region of ion production through an electric field, E, established within the bulk of the discharge near the anode of the apparatus. The electric field is brought about by a static or quasi-static magnetic field, B, imposed on the discharge in the vicinity of an anode wherein the electron drift motion from cathode to anode is impeded by the magnetic field. Electrons formed at the cathode ionize feed gases as they drift toward the anode through the magnetic field via collisional and anomalous diffusion. The restricted mobility of electrons across the magnetic flux forms a space charge near the anode and a relatively strong electric field that is substantially orthogonal to the imposed magnetic field and anode surface. Ions generated within anode discharge region are accelerated away from the anode. Since the anode discharge and ion acceleration regions do not exclude electrons, ion beam current densities are not restricted by space-charge limitations that are inherent in electrostatic acceleration optics. The electrons formed at the cathode and within the discharge also serve to electrically neutralize the ion beam as it propagates away from the anode's ion acceleration region. At pressures above $10^{-4}$ Torr, ionization away from the anode discharge region and charge-exchange processes within the ion beam can form a diffusive background discharge making the output characteristics of the source appear as both an electrically neutralized, energetic ion beam and a diffusive background plasma. The combined output of both a self-neutralized ion beam and diffusive plasma is sometimes referred to as a "plasma beam".

Another characteristic feature of this type of ion source is an E×B drift current motion of electrons in the acceleration region. Electrons, which spiral about the lines of magnetic field, experience an E×B or Hall-effect force and collectively drift in a direction perpendicular to both electric and magnetic fields. This is referred to as a Hall-effect drift current. In order to avoid Hall potentials which may form along this electron drift path, these ion sources have anode discharge regions or channels that allow Hall-effect drift current to flow along a continuous and closed path. Workers have referred to these types of ion sources by many names: "Magneto-Plasma-Dynamic Arc Thrusters", "Hall-Accelerators", "Closed-Drift Thrusters", and "Hall-Current Ion Sources". For the purpose of discussion and teaching, we refer to these types of devices, in general, as "Hall-Current ion sources".

The following references illustrate the prior art with regard to Hall-Current ion sources.

The body of work on Hall-Current ion sources that have been developed for space propulsion applications is summarized by H. R. Kaufman in "Technology of Closed-Drift Thrusters" AIAA Journal Vol. 3, pages 78–87 (1983) and in the references cited therein.

Burkhart, U.S. Pat. No. 3,735,591 discloses and claims a Hall-Current ion source termed "Magneto-Plasma-Dynamic Arc Thrusters" for space propulsion applications.

Cuomo et al., U.S. Pat. No. 4,541,890 disclose and claim a high current density, low ion energy Hall-Current ion source for use in integrated circuit manufacturing processes.

Kaufman, U.S. Pat. No. 4,862,032, discloses and claims a so-called "End-Hall" ion source for the production of high current density, low energy ion beams.

Okada et al., Japanese Journal Applied Physics, Vol. 31, pages 1845–1854 (1992), describe a high energy Hall-Current ion source used for ion implantation and deposition of diamond-like carbon (DLC) coatings.

The articles by Chuzhko, et al. in Diamond and Related Materials, Vol. 1, pages 332–333 (1992), and Fedoseev, et al.

in Diamond and Related Materials Vol. 4, pages 314–317 (1995) describe a Hall-Current ion source used in deposition of DLC coatings.

Hall-Current ion sources have been used to generate chemically inert and reactive ion beams for space propulsion and materials processing applications. While several designs have been developed, Hall-Current ion sources may be classified into three basic configurations as illustrated in FIGS. 1A through 1C. FIGS. 1A–1C distinguish between the non-magnetic stainless steel (SS) of the anode, the magnetic stainless steel of the pole pieces and insulative material, which are often used in these ion sources.

FIG. 1A shows "Extended Channel" Hall-Current ion source 10 with extended anode discharge region or acceleration channel 14. Ion source 10 comprises several parts: circular, cylindrical channel or anode discharge region 14 consisting of an insulative material and having opening 16 at first end 17 and at least one flat ring anode 18 consisting of a non-magnetic stainless steel located within and adjacent second end 20 of channel 14; gas feed line 22 communicating with anode discharge region 14 behind anode 18 at second end 20; magnetic circuit having pole pieces 26 consisting of magnetic stainless steel and forming a radially directed magnetic field, B; one or more electromagnets 30 (or permanent magnets 30); cathode 34; and discharge power supply 38 electrically connected between cathode 34 and anode 18. Extended channel 14 has an aspect ratio of channel length, L, over channel width, W, greater than 1 (L/W>1).

FIG. 1B shows "Space-charge Sheath" Hall-Current ion source 40 having much shorter cylindrical channel 44 than channel 14, typically channel 44 has L/W<1. In addition, ion source 40 has ring anode 48 having groove or channel 50. This type of Hall-Current ion source with a relatively shorter anode discharge region produces an ion beam with mean energies that are typically lower than that of the extended channel type, but has the advantage of greatly reduced discharge losses to the walls which bound the anode discharge region. In the ion source of FIG. 1B, the electron current between cathode and anode principally makes contact to the inner and outer tips of the grooved ring anode 48 which extend into and cross the magnetic field lines.

FIG. 1C shows yet a third type of Hall-Current ion source of the prior art, "End-Hall" ion source 60. In End-Hall ion source 60, magnetic pole pieces 26 are arranged to form an end-divergent magnetic field that is directed along the axis of the ion source and is directed through opening 16 and to outer pole 28. Conical, annular 64 defines the anode discharge region 68.

Hall-Current ion sources must meet several criterion in order to be suitable for production at high deposition rates. It should be noted that many of these criterion discussed in some detail below apply to both ion beam deposition and non-deposition processes.

First, high deposition rates generally require high discharge power levels. Typically 50 to 70 percent of the electrical power delivered to a Hall-Current ion source is directly or indirectly lost to heating of the ion source components. If the source is passively cooled by radiative thermal emission in vacuum, thermally sensitive workpieces, such as plastics may be damaged by thermal flux from the hot ion source assembly. Thus, in order to facilitate high deposition rates, it would be desirable to cool the Hall-Current ion source by means other than radiative thermal emission.

Second, the ion source must operate robustly in production. The ion source must ignite reliably and easily and have the broadest possible operating range in power and pressure. The source should not operate in any manner that would degrade its own internal components or output efficiency. The output properties of the plasma beam should remain consistent over time and should be substantially uniform or at least symmetric with respect to the scale and symmetry of the apparatus. Moreover, all of these attributes should consistently hold for the ion source throughout prolonged periods, i.e., >20 hours of continuous coating operation. For applications where conductive coatings are generated, (coatings with bulk resistance substantially $<10^2$ Ohms-cm), spurious deposition over non-conducting surfaces on the ion source must not lead to short circuits between electrically active components. Conversely, in applications where non-conducting coatings are produced, (coatings with bulk resistance substantially $>10^2$ Ohms-cm), electrically critical surfaces on the ion source must not be entirely coated with insulating deposits.

Third, the Hall-Current ion source should be scalable such that large surface areas can be processed with minimal workpiece manipulation within the plasma beam in order to achieve a desired coating uniformity.

The use of an End-Hall ion source for direct ion beam deposition of abrasion resistant coatings is described by Knapp et al., U.S. Pat. No. 5,508,368. They disclose a process which deposits highly abrasion resistant coatings with thicknesses of 1 to 10 $\mu$m over various substrates including plastic materials such as acrylic and polycarbonate. The coatings were produced by injecting precursor gases and vapors directly into the plasma beam downstream of the ion source anode discharge region. In their work, total volumetric coating rates were in the range of about 0.01 to 0.1 $cm^3$/min. However, when attempting to apply End-Hall and other Hall-Current ion sources of the prior art to the process disclosed by Knapp et al. at higher deposition rates (0.1 to 1 $cm^3$/min.), many technical problems arise concerning the performance of the ion source apparatus.

For example, several complications arose when attempting to adapt either of two commercial versions of the End-Hall ion source (the Mark II End Hall Ion Source and the Mark III End Hall Ion Source, manufactured by Commonwealth Scientific Corporation, Alexandria, Va.) into a commercial production setting for coating plastics at very high deposition rates. These End-Hall ion sources were radiation cooled and as such their power ranges were very limited when coating thermally sensitive plastics for prolonged periods due to the high thermal power flux emitted from hot ion source components. Furthermore, the ion sources were prone to physically sputter metal from the gas distributor plate located near the base of the anode assembly. Typically the potential of this electrically floating plate is many tens of volts lower than that of the anode and some of the ions produced in the anode discharge region are accelerated back toward the gas distribution plate. This ion bombardment keeps the gas distributor plate relatively free of non-conductive deposits, but heats the electrically floating plate and sputters metal contaminants into the plasma beam. Such metal contaminants were found to cause poor processing performance, e.g., poor film adhesion, optical defects and the like, over the treated workpiece. Also, the anode assemblies in the commercial End-Hall ion sources would frequently arc to both grounded and floating metal components within the ion source body. These random transient arcs sputtered metal onto electrical insulators within the assembly causing electrical short circuits and would often extinguish the discharge during a coating operation, with no simple means to immediately re-ignite the discharge. Moreover, these arc events became more pronounced and frequent when using hard-to-ionize feed gases, when operating at higher power levels, and when depositing non-conductive coatings.

Given these problems, the End-Hall ion sources described by Kaufman in U.S. Pat. No. 4,862,032 and commercially manufactured by Commonwealth Scientific Corporation were unsuitable for production of coatings deposited by means disclosed in the Knapp et al. U.S. Pat. No. 5,508,368 when attempting to operate these ion sources at very high deposition rates. Furthermore, there is no method or teaching disclosed in the Kaufman '032 patent, nor means obvious to one of ordinary skill in the art that would lead to solutions to these shortcomings.

Other patents and reports in the prior art describe the use of Hall-Current ion sources for prolonged operation in either inert or reactive gases and for direct deposition of material from the ion source plasma beam. Yet none describe or teach how to overcome problems associated with depositing coatings, particularly those problems associated with high rate deposition of non-conductive coatings over thermally sensitive materials.

The "Magneto-Plasma-Dynamic Arc Thruster" described by Burkhart, U.S. Pat. No. 3,735,591 and referred to above is radiation cooled and operates at power levels that are too low or at temperatures that are too high to support very high deposition rates on thermally sensitive materials. Also, this device uses a cathode located directly within the plasma beam, an undesirable condition in that the cathode can electrostatically perturb the plasma beam and become a source of sputter contamination. In this Hall-Current ion source, gas is injected into the source by means of at least one tube through the hollow, cylindrical anode wall. As will become evident in other prior art examples, prolonged operation of this ion source during the deposition of non-conductive coatings will concentrate the discharge current at the gas feed opening, producing a non-uniform plasma beam and damaging, i.e., by melting or vaporizing, the anode wall about the gas inlet when operating at high discharge currents.

Similar problems are observed in all prior art Hall-Current ion sources developed for space propulsion applications. All of these Hall-Current ion sources emphasize low power operation, lightweight components, high specific impulse and thrust efficiency, and long-life operation when using chemically inert propellant fuels such as argon or xenon, or in some cases easily ionizable metals such as cesium. A common feature of space propulsion Hall-Current ion sources is that they are cooled by radiative thermal emission. In continuous operation they can be operated only at relatively low power, and this limitation becomes more restrictive as they are made more compact and lightweight, as desired for space propulsion applications. As such, the prolific literature in this area provides no teaching on means or methods related to the use of Hall-Current ion sources for operation at high power and in chemically active or depositing environments.

In the preferred embodiment described in Cuomo et al., U.S. Pat. No. 4,541,890, of a radiation cooled Hall-Current ion source, working gases are introduced into the anode discharge chamber from behind and adjacent the anode by a separate annular manifold that is also electrically isolated from the anode. As will become evident in later prior art examples, this means of gas distribution may be made to operate with inert, non-depositing gases. However, in the case of depositing gases, this same Hall-Current ion source is prone to failure. Non-conductive deposits can readily form on those regions of the anode that are exposed to the depositing environment, after which the electrically active anode area contracts to surfaces behind the anode where line-of-sight deposition is low or negligible. Channeling of high energy electrons into these areas can drive intense discharge activity behind or alongside the anode assembly, rather than within the anode discharge region as desired for efficient operation. Moreover, the intense discharge activity between the anode and non-anode surfaces, such as the gas distribution manifold, can lead to ion sputtering and/or overheating of either grounded or floating metal or insulating non-anode surfaces. Depending on the assembly, sputtered metal can form short circuits across insulating hardware and inject metal contaminants into the process. It should be noted that Cuomo et al. do not discuss or teach any means by which to address the disabling problems that would be encountered in their ion source when applied to high rate deposition processes.

In a recent work by Feedoseev, et al., described in the article referred to above, a so called "Hall Accelerator" ion source with a water-cooled anode was used to produce DLC coatings from a mixture of hydrogen, argon, and methane feed gases. In their Hall Accelerator design, gases are delivered uniformly into the anode discharge region through a 0.02 cm wide annular slot in the base of a V-shaped, annular anode. While it has been demonstrated that this ion source can be used to deposit DLC coatings from hydrocarbon feed gases, it was observed that this same ion source failed when attempts were made to integrate it into the process disclosed by Knapp, et al. in the above reference. Non-conductive deposits formed on the Hall Accelerator anode, which reduced the electrically active surface area and increased the anode potential. Eventually the potential on the anode was sufficiently high for the gas behind the anode to break down, and arcs occurred to conductive surfaces within or behind the ion source. The presence of non-conducting coatings on the anode also made it very difficult to re-ignite the ion source. It is known that during DLC deposition, deposits on hot ion source surfaces can be graphitic in composition and thus electrically conductive. Presumably, this occurred on areas of the Hall Accelerator anode that were insufficiently cooled, such as at the tips of the V-shaped anode where much of the discharge electron contact current is intended to occur. In the process described by Knapp, et al., however, deposits on both hot and cold regions on the anode are non-conductive, and thus their presence disabled the Hall Accelerator ion source.

A Hall-Current ion source with an extended channel was used by Okada et al. in the work described in the article referred to above to deposit DLC films from a combination of argon and various hydrocarbon gases. The relatively bulky and sophisticated device uses many electromagnets to form a magnetic field within its extended acceleration channel. There is no direct, active cooling of the anode assembly and the ion source does not use a self-sustained cathode. There have been no disclosed reports on the use of this apparatus in environments where non-conductive deposits form on the hot anode. Also, there are no disclosed embodiments within this extended channel Hall-Current ion source that possess unique advantages over any other Hall-Current ion source of the prior art with regard to common problems encountered in direct deposition of non-conductive coatings.

The following general technical problems confront the application of prior art Hall-Current ion sources to processes where high rate deposition or high power operation are required.

The radiation-cooled Hall-Current ion sources of the prior art are not suitable for rapid treatment and coating of thermally sensitive materials. During high power operation, the radiative thermal energy from the hot ion source will heat and potentially damage thermally sensitive workpieces. Thus, it is important to extract thermal energy from the ion source apparatus by a means other than radiative thermal emission.

When depositing non-conductive coatings with Hall-Current ion sources, coatings will cover those areas of the clean anode surface that are exposed to the anode discharge region. This decreases the active anode area and eventually causes the ion source to fail in a number of ways. In ion sources of the prior art where gas is delivered around the anode, the active anode surface contracts to areas to the side and behind the anode, and as a result, power delivered to the discharge tends to be diverted into wall recombination losses about the perimeter and behind the anode, rather than into volume ionization and ion acceleration within the anode discharge region. In ion sources of the prior art where the gas is injected through the anode by one or more discrete holes, the active anode area contracts to a high current density region within close proximity about the discrete gas injection hole(s). In the case of one hole, the discharge in the acceleration channel and the resulting plasma ion beam profile becomes non-uniform or asymmetric. Moreover, the intense electron current to the small conductive surface area can locally melt and evaporate the anode metal when the source is operated at high current levels. In the case of an array of holes or a thin continuous slot in the anode that is directly open to the anode discharge region, the active anode surface can diminish to such a degree, particularly during high-rate deposition conditions, that the ion source will become unstable and rise outside its anode voltage operating range. Eventually the ion source discharge current will become extinguished or fail to flow solely between the cathode and anode discharge region.

When depositing conductive coatings with Hall-Current ion sources of the prior art, spurious deposition on the non-conductive surfaces can degrade the isolation between electrically active components. Early on this will lead to unknown power losses that can reduce deposition rates. Eventually the anode-to-cathode potential drop will decrease to the point where the plasma can no longer be sustained.

Many of the Hall-Current ion sources in the prior art also exhibit unstable performance, often operating with difficulty to ionize gases, as a result of either instabilities in the discharge or "sparks" or "arcs" between the anode discharge region and metal boundaries near this region. These events can diminish or divert the discharge current within the anode discharge region and disrupt the discharge properties, ie., charged-particle densities and plasma potential fields, to such a degree that the discharge will be extinguished. It is desirable to have a Hall-Current ion source that does not exhibit such instabilities or arcing events or that is at least insensitive to their occurrence.

Many of the Hall-Current ion sources in the prior art have metal components that bound the anode discharge region. Ion bombardment can sputter metal from these surfaces even under conditions of non-conductive coating deposition where the concomitant ion sputtering and heating of such surfaces compete with deposition. It is desirable to eliminate or minimize sputtering from all metal components which can contaminate the coating process or which can lead potentially to electrical short circuiting of the anode.

Nearly all Hall-Current ion sources of the prior art make use of either permanent magnets or electromagnets driven with an independent power supply to form a static magnetic field. As such, these Hall-Current ion sources do not always ignite easily and reliably over their desired range of operation. Because the anode voltage threshold and feed gas levels required to breakdown the working gases are greater than those required for steady-state operation. Thus, the ignition process of Hall-Current ion sources of the prior art have an inherent hysteresis. Workers must alter the magnetic field strength, induce a high-voltage wave form, or alter gas flows dynamically in order to ignite the discharge and then re-adjust these properties to desired set points. A less complicated ignition procedure is desired to easily ignite the discharge and operate the ion source over its broadest possible steady-state range. Rapid and easy ignition is particularly desirable for rapid-rate deposition of very thin coatings (50 to 100 Angstroms) which may require only a few seconds of ion source operation.

It is difficult to scale conventional Hall-Current ion sources to process large areas without significantly increasing their gas feed requirements for stable operation. All Hall-Current ion sources of the prior art make use of a closed-path anode discharge region in order to avoid the formation of asymmetric Hall-potentials along the E×B drift path of the electrons, which in turn leads to asymmetric plasma beam properties. In some processes, it would be highly advantageous to form a linear plasma beam that is distributed over a large surface such as a moving sheet, fixture, flat panel or web. Such a linear Hall-Current ion source built with a conventional closed-path must have a closed-drift anode discharge region that is at least twice the length of the linear ion source. It has been observed that the gas load requirements of a Hall-Current ion source tends to scale with the circumference or length of the closed-path of the anode. Thus, a large linear Hall-Current ion source configured with a conventional closed-path would require substantially high gas feed levels and high vacuum pumping speed for stable operation. Yet it generally is not desirable to scale gas and pumping requirements in an effort to merely re-distribute the geometry of the ion source's output. It is more desirable to have a Hall-Current ion source that is not restricted by the closed-path convention of the prior art but that does not exhibit asymmetric Hall-potentials and similar asymmetries in its plasma beam properties.

In order to geometrically distribute or scale the output of the plasma beam from Hall-Current ion sources of the prior art, multiple ion sources with multiple anodes and cathode power supplies and, in many cases electromagnet power supplies are required. It would be desirable to distribute the power from one or more power supplies to several anodes or anode discharge regions, such as an array of anodes, by distributing the discharge current between two or more anodes and then combining the currents to a single common cathode. Such a method would minimize the number of power supplies and ion source components necessary to form a plasma beam for processing large areas. Also, such an approach requires a means by which to balance the ratio of discharge current and power delivered to each anode in the ensemble. Aside from ganging multiple Hall-Current ion sources together, there is no teaching in the prior art on means by which to electrically combine and control such an ion source system.

Set forth below is a summary of the shortcomings of the Hall-Current ion sources of the prior art.

(1) Radiative thermal emission that is detrimental to thermally sensitive workpieces.

(2) Extensive coating of the anode surface with non-conductive coatings inherent in the process that leads to:

(a) non-uniform or asymmetric discharge formation about the anode discharge region where ions are principally produced and accelerated;
(b) contraction of the electrically active anode surface to areas along side and behind the anode;
(c) localized, high discharge current densities at the anode that lead to damage of the anode surface; and
(d) loss or disruption of the discharge current between the anode discharge region and cathode.

(3) Unreliable operation in environments where conductive coatings are deposited.

(4) Frequent arcing between the anode and non-anode metal components and sensitivity to transient arcs and instabilities that lead to loss of the discharge current or its redirection outside the anode discharge region.

(5) Metal sputtering from metal components of the ion source within the anode discharge region or within the plasma beam.

(6) No simple, rapid and electrically passive means by which to ignite the ion source discharge or re-establish the ion source discharge current in the event of an inadvertent, transient loss of the discharge current.

(7) No means by which to scale a Hall-Current ion source with a non-closed anode path and means to avoid asymmetric Hall-potentials in the anode discharge region and in the plasma beam.

(8) No simple means by which to connect multiple ion source systems or anodes in parallel with a common cathode and anode power supply so as to distribute and control the discharge power, currents, and plasma beam properties over large processing areas.

SUMMARY OF THE INVENTION

The apparatus of the present invention provides a closed path or non-closed path Hall-Current ion source that embodies features which overcome the problems encountered with the ion sources in the prior art when used in production environments. The ion source of the present invention incorporates a non-radiative or fluid-cooled anode that provides a conductive surface area or areas where electron contact current can be sustained continuously and substantially uniformly about the anode when processing materials with chemically active (i.e., corrosive) or depositing environments. As a result, this ion source can be used in three modes of vacuum processing thermally sensitive materials or workpieces at very high production rates. These modes include: (1) non-deposition applications such as the surface modification of workpieces, e.g., reactive ion beam etching or non-reactive ion beam sputter etching to alter the surface texture, masked profile, or adhesion properties of various substrates; (2) deposition of conductive coatings onto a substrate; and (3) deposition of non-conductive coatings onto a substrate.

The ion source for mode (1) applications require:

(a) an anode discharge region for the formation and acceleration of a plasma beam;
(b) an insulatively sealed anode to prevent plasma from forming behind the anode;
(c) a non-radiative cooling means for cooling the anode;
(d) a self-sustaining cathode, i.e., a cathode having an independent power supply;
(e) an electromagnetic means that operates at least partially on either the discharge current from the anode to the self-sustaining cathode or current from an independent, periodically reversing or alternating current; and
(f) a gap within the anode to introduce plasma maintenance gas or working gas.

The ion source for mode (2) applications require:

(a) an anode discharge region for the formation and acceleration of a plasma beam with the anode bounded by one or more continuous thin gaps so disposed to prevent deposition in the gaps which in turn prevents the formation of conductive paths between the anode and other parts of the ion source adjacent to the anode;
(b) an insulatively sealed anode to prevent plasma from forming behind the anode;
(c) a non-radiative cooling means for cooling the anode;
(d) a self-sustaining cathode;
(e) an electromagnetic means that operates at least partially on either the discharge current from the anode to the self-sustaining cathode or current from an independent, periodically reversing or alternating current;
(f) a gap within the anode to introduce plasma maintenance gas or working gas; and
(g) distribution means for introducing and distributing depositing gases directly into the plasma beam.

The ion source for mode (3) applications require:

(a) an anode discharge region for the formation and acceleration of a plasma beam;
(b) an insulatively sealed anode to prevent plasma from forming behind the anode;
(c) a non-radiative cooling means for cooling the anode;
(d) a self-sustaining cathode;
(e) an electromagnetic means that operates at least partially on either the discharge current or current from an independent, periodically reversing or alternating current;
(f) a gap within the anode to introduce plasma maintenance gas which provides an anode surface area within gap that remains substantially free of non-conductive deposits; and
(g) distribution means for introducing and distributing depositing gases directly into the plasma beam.

Specifically, the ion source apparatus of the present invention to facilitate all three modes includes a housing; an anode discharge region within the housing having an anode at one end; an anode with non-radiative cooling means; a self-sustaining cathode; a power supply means connected to the anode for supplying a voltage between the anode and the cathode; an injection means for introducing working gases through at least one gap within the anode; and an electromagnetic means mounted in the housing and operating at least partially either on the discharge current or current from an independent, periodically reversing or alternating current.

It is possible to devise the ion source apparatus of the present invention with either a conventional closed or an unconventional non-closed Hall-Current drift path region to facilitate all three modes of operation. The non-closed path Hall-Current ion source uses a periodically reversing or alternating magnetic field in order to form a plasma beam whose spatial time-averaged output is symmetric with respect to the geometry and scale of the ion source. The non-closed path Hall-Current ion source is particularly useful in treatment and coating applications where the ion beam output of a linear ion source is desired.

Also, the ion source apparatus of the present invention may be configured with multiple anodes, anode discharge regions, self-sustained cathodes, electromagnets and power supplies in order to operate an array or ensemble of ion source assemblies. Such ion source configurations are desired in order to spatially distribute the ion beam output as necessary to treat workpieces with large surface areas and/or complex shapes.

DETAILED DESCRIPTION OF THE INVENTION

Figure 1A:
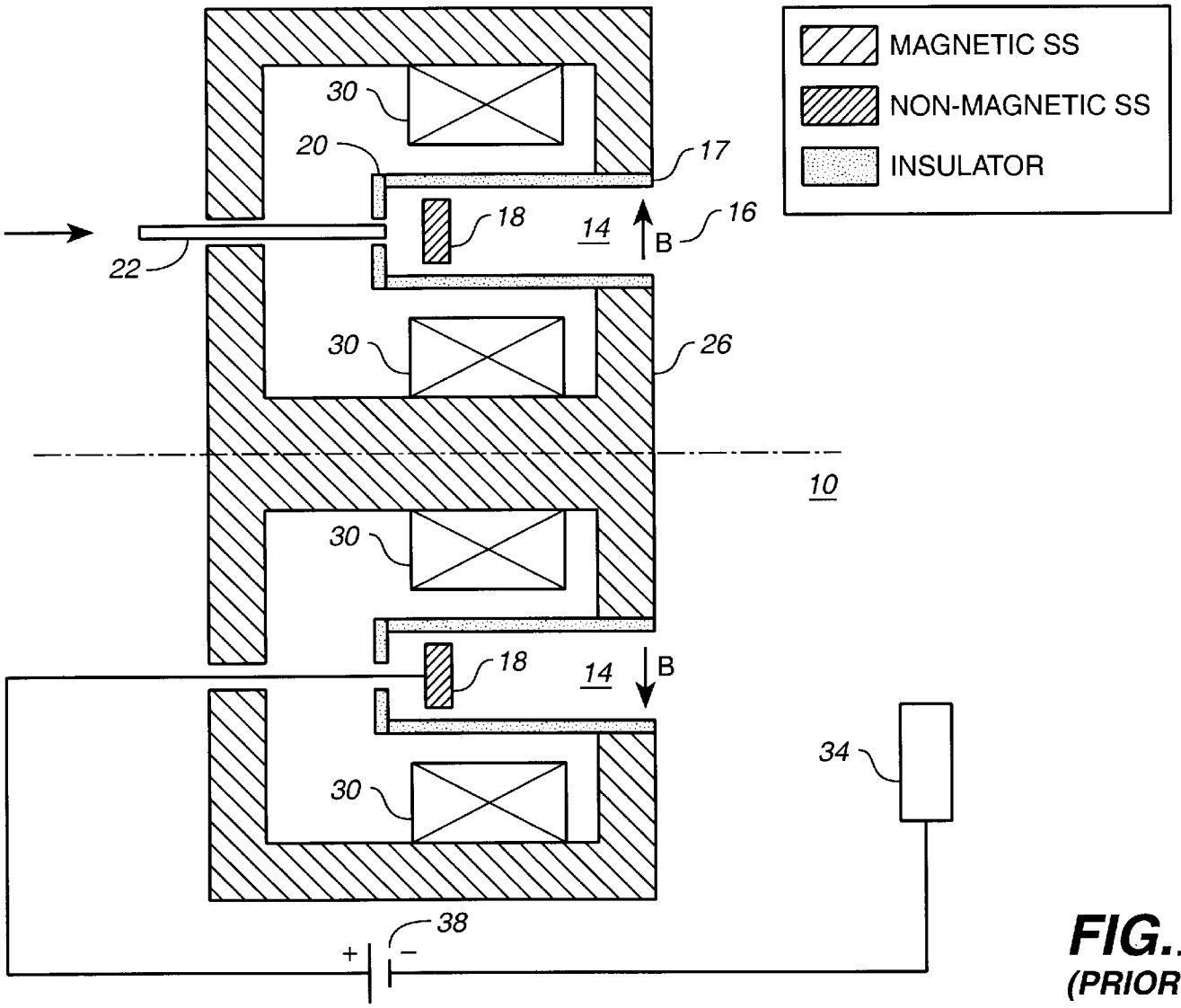
FIG. 1A (PRIOR ART)
FIG. 1A is a diagrammatic cross-sectional view of an extended channel type (L/W>1) Hall-Current ion source.

The gridless Hall-Current ion source apparatus of the present invention for processing thermally sensitive materials overcomes the shortcomings associated with Hall-Current ion sources of the prior art by:

(1) operating at low temperatures and high powers;

(2) maintaining a surface area on the anode that is substantially free of non-conductive coating so as to sustain a discharge current between the cathode and the anode discharge region at all times during deposition;

(3) maintaining electrical isolation of the electrically active components in environments where conductive coatings are deposited;

(4) injecting working gases through the anode and into the anode discharge region such that ionization of the feed or deposition gases occurs principally within the anode acceleration region rather than along side or behind the anode assembly;

(5) inhibiting transient arcing from the anode to non-anode surfaces about and within the ion source housing;

(6) exhibiting substantially low sputter erosion of metal from its components;

(7) being robust in that the ion source is insensitive to instabilities in the ion source discharge and to inadvertent arcs about the ion source;

(8) providing easy and reliable ignition and/or re-ignition of the ion source discharge in case of its intended or inadvertent disruption; and (9) distributing and controlling power to any array of Hall-Current ion sources or anodes of the present invention with the use of as few as one self-sustaining cathode and as few as one power supply so as to geometrically distribute a plasma beam over a large processing area.

The Hall-Current ion source apparatus of the present invention incorporates a fluid-cooled anode with a unique shadowed-gap and gas distribution feature, one or more enclosed anode discharge regions with electrically insulating walls and/or electrically isolating gaps that seal against the anode, and the use of one or more electromagnets connected in series with the anode-to-cathode current path. These essential features, combined with other novel embodiments, are illustrated in the following detailed description of the invention.

In the Hall-Current ion source apparatus of the present invention, gases or vapors are introduced, completely or in part, into the ionization and ion acceleration channel, or anode discharge region, by means of the unique self-shadowing gap in the anode or anode assembly. The introduction of working gases through this anode gap inhibits undesirable discharge activity behind or along side those surface areas of the anode that do not effectively face the anode discharge region. Also, the anode assembly is enclosed within the ion source housing by an electrically insulating boundary or assembly so as to prohibit sustained or transient arcing between the anode and non-anode conductive parts within the interior of the housing. This unique anode configuration enables the Hall-Current ion source of this invention to continuously operate at high current and discharge power levels for prolonged periods of time, i.e., greater than 20 hours, even when depositing non-conductive coatings. Non-conductive coatings are defined as those having a bulk resistance of greater than about $10^2$ Ohm-cm.

The Hall-Current ion source apparatus of the present invention is ideally suited to applications in a number of important industrial processes. These processes include, but are not limited to, ion beam milling, reactive ion beam etching, ion beam sputter-etching, ion beam assisted deposition, ion implantation, ion beam ashing, and direct ion beam deposition of conductive and non-conductive coatings. In the context of these types of processes, the Hall-Current ion source of the present invention may be used in key industrial applications including fabrication of semiconductor and opto-electronic devices; fabrication of magnetic, magnetic-opto and optical phase-change data storage media components; surface treatment and modification for wetting and bonding of materials; production of barrier coatings for packaging, pharmaceutical and chemical applications; deposition of low emissivity, anti-reflection, filter and bandpass optical coatings; wear-resistant, corrosion-resistant, and abrasion-resistant protective coatings.

The characteristics of the Hall-Current ion source apparatus of the present invention make it an ideal source for the deposition of diamond-like carbon (DLC) protective coatings on magnetic media transducers, as in Knapp, et al., International Application under the PCT, WO 95/23878, published Sep. 8, 1995; silicon-doped DLC protective coatings on magnetic transducers and magnetic media, as in pending patent application U.S. Ser. No. 08/707,188, filed Sep. 3, 1996 (attorney docket #6051/53132); DLC and doped DLC protective coatings on optical phase-change data storage media, as in pending U.S. patent application, filed Jul. 2, 1997 (attorney docket #6051/53271); DLC and other protective hard optically transparent coatings on optical substrates such as laser bar code scanner windows, as in pending patent application U.S. Ser. No. 08/631,170, filed Apr. 2, 1996 (attorney docket #6051/53119) and Knapp, et al., U.S. Pat. No. 5,508,368, issued Apr. 16, 1996; highly abrasion-resistant and flexible protective coatings for soft substrates, as in Petrmichl, et al., U.S. Pat. No. 5,618,619, issued Apr. 8, 1997; and highly durable and abrasion-resistant multi-layer dielectric coatings for lenses, as is pending patent application U.S. Ser. No. 08/632,610, filed Apr. 15, 1996 now U.S. Pat. No. 5,846,649, issued Dec. 8, 1998 (attorney docket #6051/53123). Relevant portions of the foregoing publications, patents and applications are incorporated herein by reference.

In one embodiment of the present invention, the Hall-Current ion source is configured with a conventional closed anode discharge path as will be described below in connection with the description of FIGS. 2 and 3. In order to facilitate a wide operating range in pressure, flow and discharge power, the magnetic field in the anode discharge region is driven by one or more electromagnets in series with the discharge current between the anode and the self-sustaining cathode. This relatively simple means of establishing the magnetic field provides reliable ignition and re-ignition for step-and-repeat operation and pulsed-power operation, and assures quick recovery from any loss of the discharge due to inadvertent transient arcs or instabilities in the discharge apparatus.

In another embodiment of the present invention, the Hall-Current ion source is configured with an unconventional non-closed anode discharge path in order to treat surfaces or deposit coatings over large areas with minimal feed gas requirements. A particular embodiment of the non-closed Hall-Current ion source of this embodiment is to include means to periodically alternate or reverse the direction and strength of the magnetic field and the lateral drift of electrons within the anode discharge region as will be described below in connection with the description of FIGS. 4A and 4B. In such a reversing means, asymmetric Hall-potentials are evened out which would otherwise form along a non-closed anode discharge region. This novel, non-closed drift path configuration has properties and performance comparable to the more conventional closed path configurations with a non-alternating magnetic field.

Furthermore, several of these Hall-Current ion sources of the present invention with the particular embodiments noted above can be combined with various DC electrical power circuits in order to form a self-balancing ensemble of Hall-Current ion sources powered by a single anode supply of the present invention and a single common self-sustaining cathode. Such arrangements could include two or more anodes, two or more concentric anodes, a linear anode array or a clustered array of anodes. These advancements make it possible to combine several Hall-Current ion sources and distribute the plasma beam current and power over large areas and to reliably and uniformly deposit coatings as required in many materials processing applications In FIGS. 2 and 3A, the basic components of the closed path Hall-Current ion source apparatus of the present invention are shown. Hall-Current ion source 70 comprises cathode assembly 74, magnetic field circuit assembly or electromagnet 76, anode assembly or anode 80, and separate power supply means 84 and 86 for supplying a voltage to drive cathode electron emitter source 74 via cathode connection 87 and power supply means 88 to drive anode 80 and electromagnet 76 via anode and electromagnet connection 89. The power supply means supplies DC, AC, RF, pulsed voltage wave forms or combinations of such voltage wave forms, although, DC and pulsed-DC are conventionally used.

Cathode 74 is an electron emitter source which may be a hot filament, a plasma electron emitting bridge or a hollow cathode electron emitter. Cathode 74 provides a ever-present supply of electrons to feed the anode-to-cathode current path. In particular, cathode 74 of the present invention is a self-sustaining, hollow electron emitter cathode similar to those developed for space propulsion applications and is similar to commercially available hollow cathode electron sources which may be purchased from Commonwealth Scientific Corporation in Alexandria, Va. and Kurt J. Lesker Company in Clariton, Pa. Cathode 74 comprises hollow refractory metal electron emitter 90 and "keeper" electrode plate 94. An inert gas from an electrically isolated gas feed line 96 is injected into emitter 90 while a voltage is applied between emitter 90 and keeper electrode plate 94 by power supplies 84 and 86 to form a locally intense discharge 98. Ion bombardment from discharge 98 heats the tip of emitter tip 90 to thermionic electron emission temperatures such that the local discharge may be sustained with minimal power levels and gas flows. Typically a power level of from about 10 to about 40 Watts and a flow of 10 sccm of Ar are required to operate cathode 74. Other cathode electron source configurations may be used such as a plasma bridge or a hot filament as taught in the prior art.

The magnetic field circuit is driven by electromagnet 76 positioned within the center of cylindrical ion source housing assembly 100. In addition to electromagnet 76, one can use permanent magnets and ferromagnetic materials or any other material having a permeability greater than unity to establish the magnetic field and to shape the direction or strength of the magnetic field within the anode discharge region. Electromagnet 76 is driven by the discharge current and may be connected directly to anode 80, a magnet-on-anode configuration, as shown. Alternatively, the discharge current may be connected to cathode 74, a magnet-on-common configuration. The magnetic circuit comprises magnetic stainless steel core assembly 106 and 108, center pole 110, outer pole 112, outer shell 114 and backplate 118. The open-gap magnetic flux is distributed radially in front of anode 80 and across anode discharge region or channel 120 extending from opening 122 at a first end adjacent the exterior of housing 100 to anode 80 at a second end. Magnetic field strengths at the center of circular region 120 typically range from about 10 to about 300 Gauss. In the ion source assembly 70 shown in FIGS. 2 and 3A, the magnetic field profile in region 120 is principally determined by the physical placement of center pole 110 and outer pole 112. The profile of anode 80 and the placement of magnetic poles 110 and 112 are configured so as to direct the transverse magnetic field lines parallel either to the electrically active surface of anode 80 or to openings in anode 80 such as shadowed annular gap 124. This provision assures that discharge current electrons, which are guided along the field lines, do not make preferential contact to high points or edges that intersect the magnetic field lines. The magnetic field lines can be directed either parallel to gap 124 or the surface of region 120, or outwardly diverging from region 120.

The non-magnetic stainless steel anode assembly 80 comprises inner anode ring 126 and outer anode ring 128, gap 124 defined by the alignment of rings 126 and 128, gas distribution manifold or ring 130 supplied by an electrically isolated gas feed line 132 and several gas injection holes 136. Holes 136 are sized and spaced so as to uniformly distribute gas from manifold 130 into gap 124. Anode 80 also includes water cooling channels 140 and 142 on inner ring 126 and outer ring 128, respectively. Anode 80 is electrically connected to power supply means 88 by means of contact 146. Anode assembly 80 is held together by two circular arrays of fasteners, e.g., shoulder screws, 148A and 148B and is isolated from the magnetic circuit assembly 76 by inner insulator ring 150 and outer insulator 152. Both of these insulators are fashioned from materials such as alumina, aluminum nitride, quartz, boron nitride, glass-bonded mica, zirconia, mixtures of the foregoing or other vacuum-compatible, high-temperature, ceramic insulators. These electrical insulators can also be deposited onto the surfaces of magnetic poles 110 and 112, and onto the surfaces of rings 126 and 128, excluding gap 124, by techniques such as a thermal-plasma spray coating. Insulators 150 and 152 isolate anode 80 from poles 110 and 112. Anode assembly 80 is attached to the underside of pole 110 by several fasteners 156 and insulators 158 comprising one of the insulator materials listed above, preferably an alumina ceramic. In order to seal the acceleration channel 120, the fit and finish of surfaces between pole 110, insulator ring 150 and ring 126, and between pole 112, insulator ring 152 and ring 128 have sufficient fit and finish so as to prohibit diffusion of plasma into the interior regions 160 of ion source housing 100.

Figure 3A:
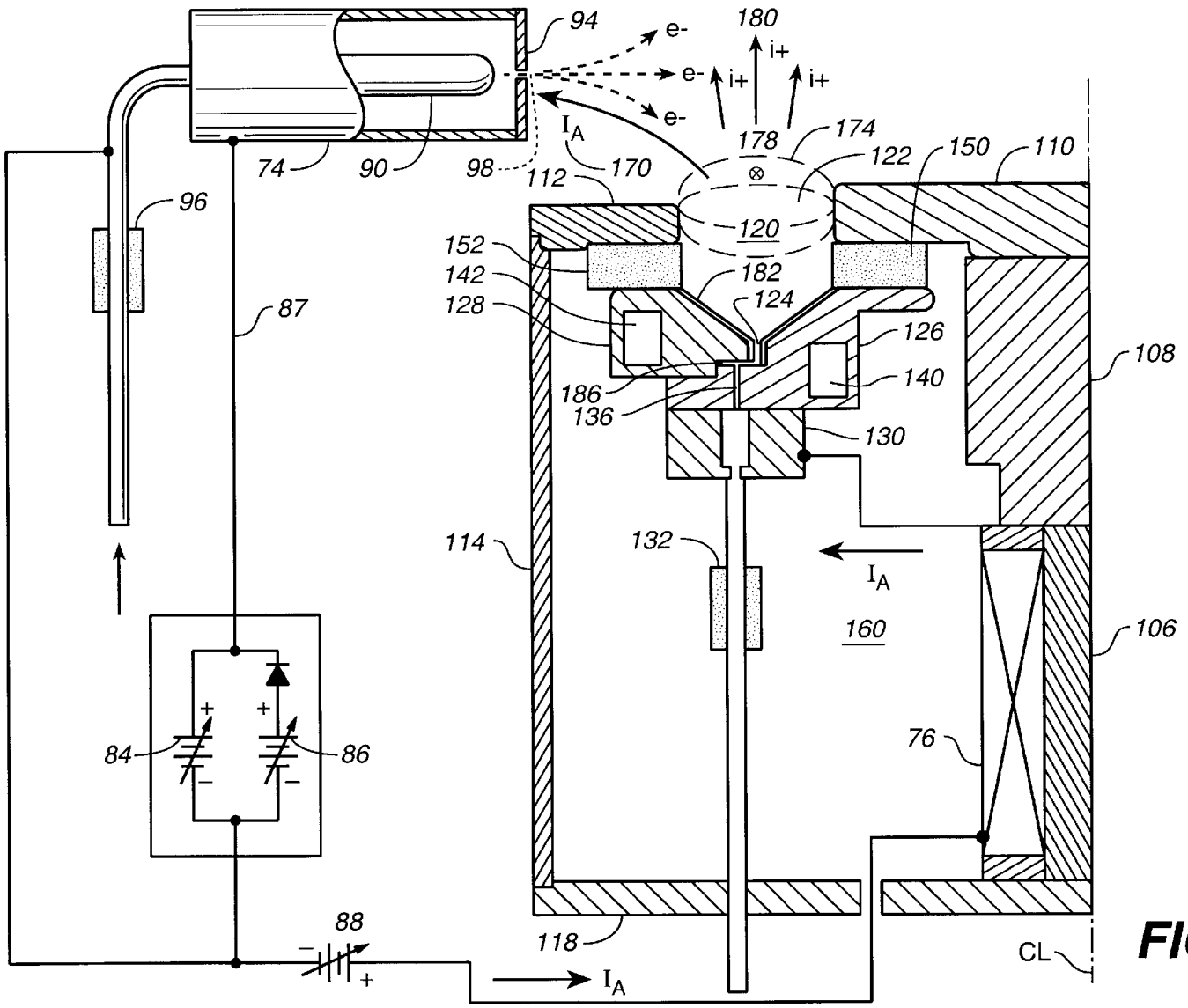
FIG. 3A is a diagrammatic cross-sectional view of the ion source apparatus shown in FIG. 2 showing the physical dynamics.
Figure 3B:
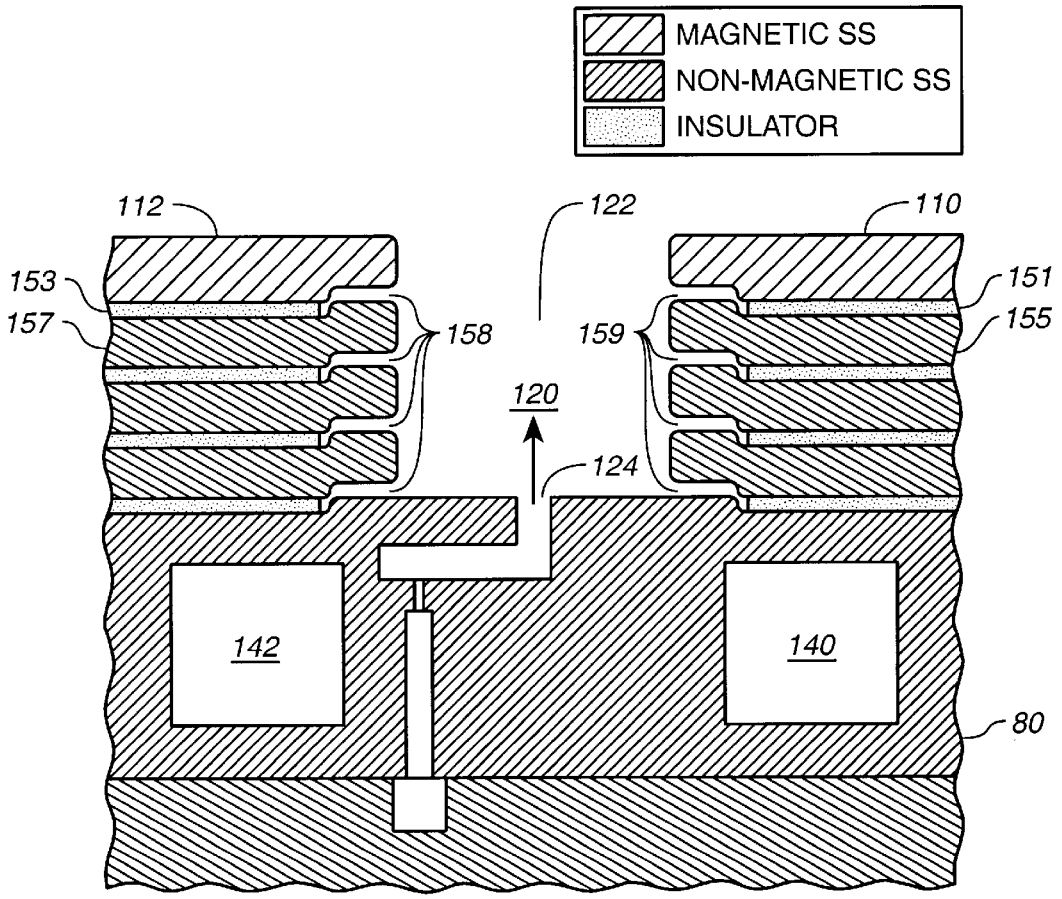
FIGS. 3B and 3C are cross-sectional details of alternative anode discharge regions respective of the Hall-Current ion source assembly shown in FIG. 3A.
Figure 3C:
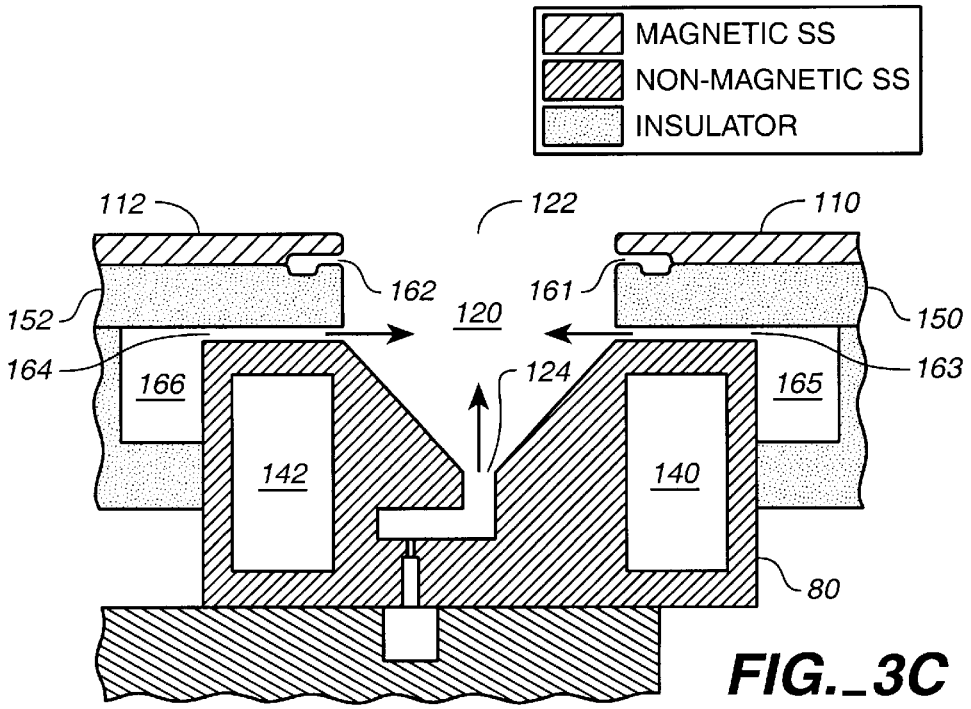

FIG. 3B and 3C illustrate alternative configurations of boundaries in the anode discharge region 120. In FIG. 3B the channel walls of 120 are formed by segmented metallic floating plates 155 and 157 separated by insulators 151 and 153 to form isolation gaps 158 and 159. Such gaps are used to maintain electrical isolation between the anode assembly 80 and magnetic circuit components 110 and 112 under conditions where a conductive layer is deposited on the exposed surfaces ion source surfaces. Isolation gaps 158 and 159 are configured and spaced so as to prohibit the formation of conductive coatings along the exposed faces of insulators 151 and 153 and prohibit the formation of plasmas deep within the gaps. FIG. 3C shows an alternative isolation approach in which thin gaps 163 and 164 are disposed between anode 80 and insulator rings 150 and 152. (Additional gaps 161 and 162 may be disposed between insulator rings 150 and 152 and magnetic pole pieces 110 and 112.) Gaps 163 and 164 may purged with inert gas flow delivered from manifold regions 165 and 166. As with the gaps 158 and 159 in FIG. 3B, gaps 161, 162, 165 and 166 are spaced so as to prohibit the formation of conductive coatings along the surfaces of insulators 150 and 152 within the gaps and also prohibit the formation of plasma deep within the gaps.

Dark space shields or "sputter caps" (not shown) may also be used in conjunction with assembly fasteners 156 and insulators 158 as additional insurance for inadvertent discharge formation and sputtering within regions 160, but are not essential components.

Figure 2:
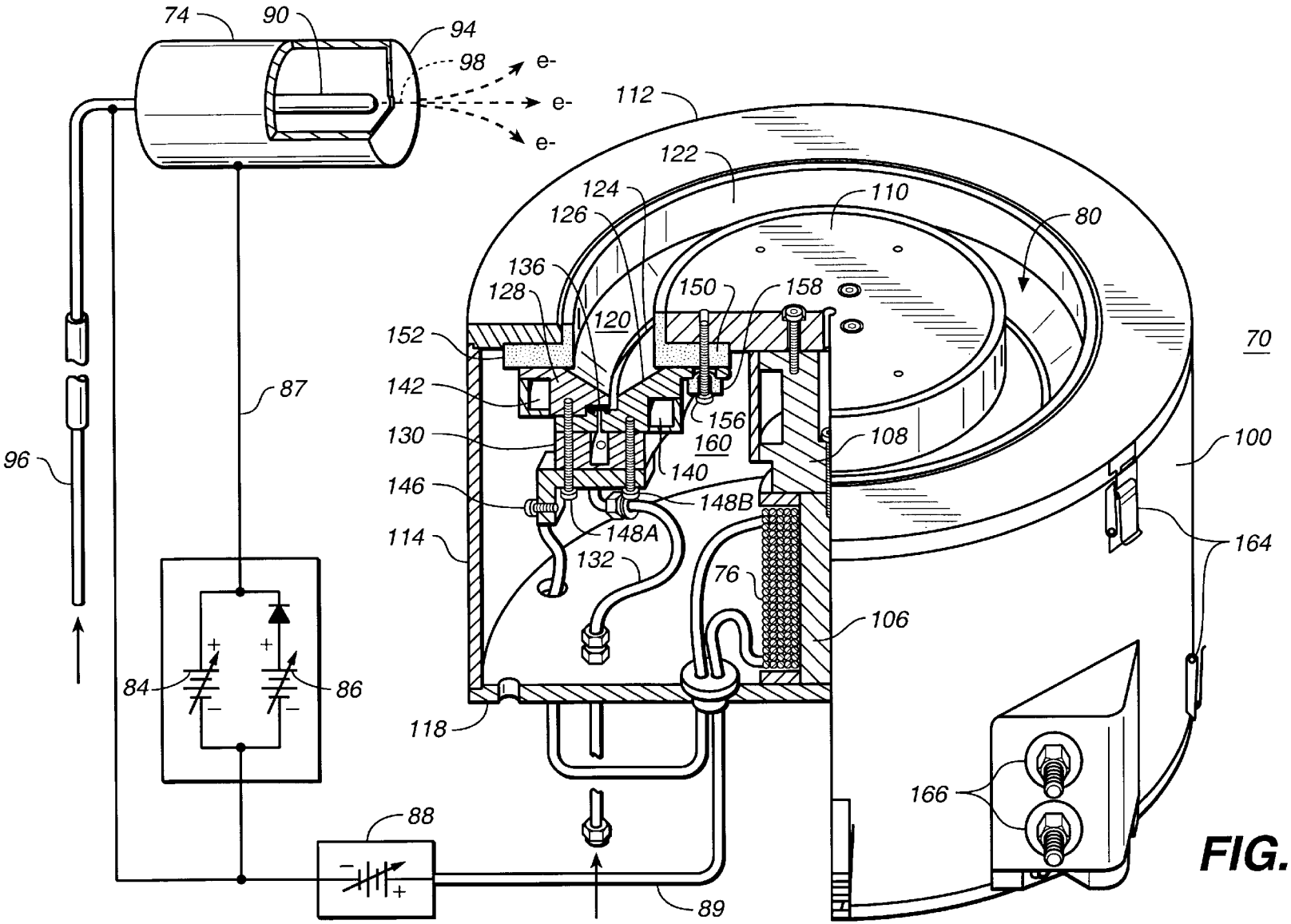
FIG. 2 is an isometric view with a one quarter cross-section of one embodiment of the ion source apparatus of the present invention including a circular Hall-Current ion source assembly with a closed anode discharge region and a self-sustaining cathode for in-vacuum mounting.

For ease of assembly and service, housing 100 and outer pole 112, outer shell 114 and backplate 118, are clasped together with spring loaded tension latches 164 (FIG. 2). Coolant feed and return services to anode 80 and magnetic core 108 are passed through outer shell 114 by electrically insulating lines (not shown) of TEFLON™ and bulkhead fittings 166 (FIG. 2). FIG. 3A more clearly illustrates the operation of Hall-Current ion source 70. At least two power supplies are required to start and sustain the ion source of the present invention. FIGS. 2–3A shows three power supplies for the purpose of illustration. Power supply 84 connected between cathode emitter 90 and keeper electrode plate 94 is the "starter" or pre-heater power supply. This power supply is used to strike a discharge at the open gap junction of emitter 90 and plate 94, which in turn heats emitter 90 to thermionic emission temperatures. Keeper power supply means 86 is in parallel with power supply means 84 and serves to maintain the discharge at the cathode 90. It is possible to incorporate the features of power supply means 84 and 86 into one power supply or power system.

Hall-Current ion source 70 is operated by first starting the cathode 74 by supplying it with inert gas, i.e. Ar, and then applying a high voltage (typically 500 to 1000 V) between keeper plate 94 and cathode emitter 90 with power supply means 84. After the cathode discharge 98 is formed and cathode 74 has reached thermionic emission temperatures, the high potential from supply 84 is be disengaged and power supply means 86 sustains discharge 98 at a lower voltage levels (40 to 100 V) to provide an ever-present supply of electrons for the initiation of the principle discharge between anode 80 and cathode 74.

After hollow cathode 74 has been started, working gases are introduced into ion source 70 through anode circular gap 124. A potential is then applied by power supply means 88 in order to start the main discharge current 170 flowing between anode 80 and the tip of cathode emitter 90. Discharge current 170 flows through electromagnet 76 to form magnetic field 174 between the poles 110 and 112 across the anode discharge region 120. With the presence of the magnetic field 174, electron mobility is restricted through region 120. As a result, the electric field between anode 80 and hollow cathode 74 has its highest strength through region 120. Hall-Current 178 annularly flows within region 120. Neutral feed gases or vapors are ionized by electrons accelerated into region 120 and ions are accelerated outwardly. Ionization principally occurs throughout region 120 and, to a lesser degree, outside region 120, thereby producing an electrically neutral plasma ion beam 180 that is characterized by a broad spread of relatively high energy ions (20 to 500 eV) and a distribution of low energy ions (0.1 to 20 eV) which would be typically encountered in a diffusive, low-pressure gas discharge. The typical pressure range for operation of the Hall-Current ion source is from about $10^{-4}$ Torr to $10^{-2}$ Torr.

The Hall-Current ion source discharge current-voltage characteristics and beam properties depend on the active anode area, the anode gas flow and gas composition, the strength and profile of the magnetic field and the depth and geometry of the anode discharge region. A Hall-Current ion source system very similar to that depicted in FIG. 3A with a nominal anode gap diameter of about 12 cm is capable of continuous operation at discharge currents ranging from about 0.5 to about 20 Amps and discharge powers up to 4 kW. Typically the ratio of total beam current to anode discharge current ($I_B/I_A$) ranges from 0.20 to 0.40 and the mean ion energy ranges between 30 and 60% of the anode potential depending upon feed gas, operating conditions, and distance from the ion source.

Deposition precursor gases or vapors are injected either through the anode or through an auxiliary gas distribution nozzle or ring (not shown). The auxiliary gas distribution nozzle or ring may be part of the ion source assembly adjacent to the anode discharge region or separate from the ion source assembly and disposed downstream from the opening of the anode discharge region.

In processes where non-conductive coatings are formed, non-conductive coatings 182 begin to deposit on the conductive anode surfaces of 126 and 128. Deposition on surfaces behind shadowed-gap 186 proceeds at a low to almost negligible rate when precursors are injected by a downstream ring or nozzle. As time progresses, insulating coatings 182 prohibit the discharge current from attaching to the exposed surfaces of 126 and 128 and the discharge contact current surface area migrates to the entrance of the shadowed gap 124 within the center of anode 80. If the discharge current $I_A$ is held constant, the reduced active anode area leads to an increase in local discharge density and the current flux density at gap 124 and within shadowed-gap 186. Eventually, the effective anode surface area in shadowed-gap 186 reaches a near steady-state condition allowing the source to continuously operate and deposit coatings for prolonged periods of time, i.e., greater than about 20 hours.

The critical width, w, of gaps 124 and 186 is the local anode sheath width, s, which is about four to ten times the Debye length, $\lambda_D$, of the local discharge adjacent to the gaps. When $w \leqq s$, it becomes difficult for a dense plasma ($10^{11}$ to $10^{12}/cm^3$) to form in the gap and maintain good electron contact of the discharge to the conductive anode surfaces that bound the shadowed gap. Thus, it is desirable to have a gap opening that prohibits line-of-sight deposition and have w substantially greater than s and much greater than $\lambda_D$. The Debye length, $\lambda_D \approx 743(T_e/n_e)^{1/2}$, within the gap, ranges from 0.004 to 0.01 cm based on reasonable estimations of the charged-particle density, $n_e$, and electron temperatures, $T_e$, as measured by Langmuir probe measurements made in close proximity to the gap within the discharge region. Typically one should expect that w be substantially greater than 0.02 cm.

In processes where conductive coatings are deposited-, the-exposed faces of isolation rings or plates along the anode discharge region 120 become coated with conductive deposits. In this application, insulator surfaces deep within the thin vacuum gaps or purged gaps, as depicted in FIGS. 3B and 3C, are not coated, and, thus, electrical isolation between the anode assembly 80 and magnetic pole pieces 110 and 112 is maintained. Since it is desirable to prohibit the formation of plasma within these particular isolation gaps, one should expect the gap widths to be substantially less than the local discharge sheath width of the plasma adjacent to the opening of the gaps.

Figure 4A:
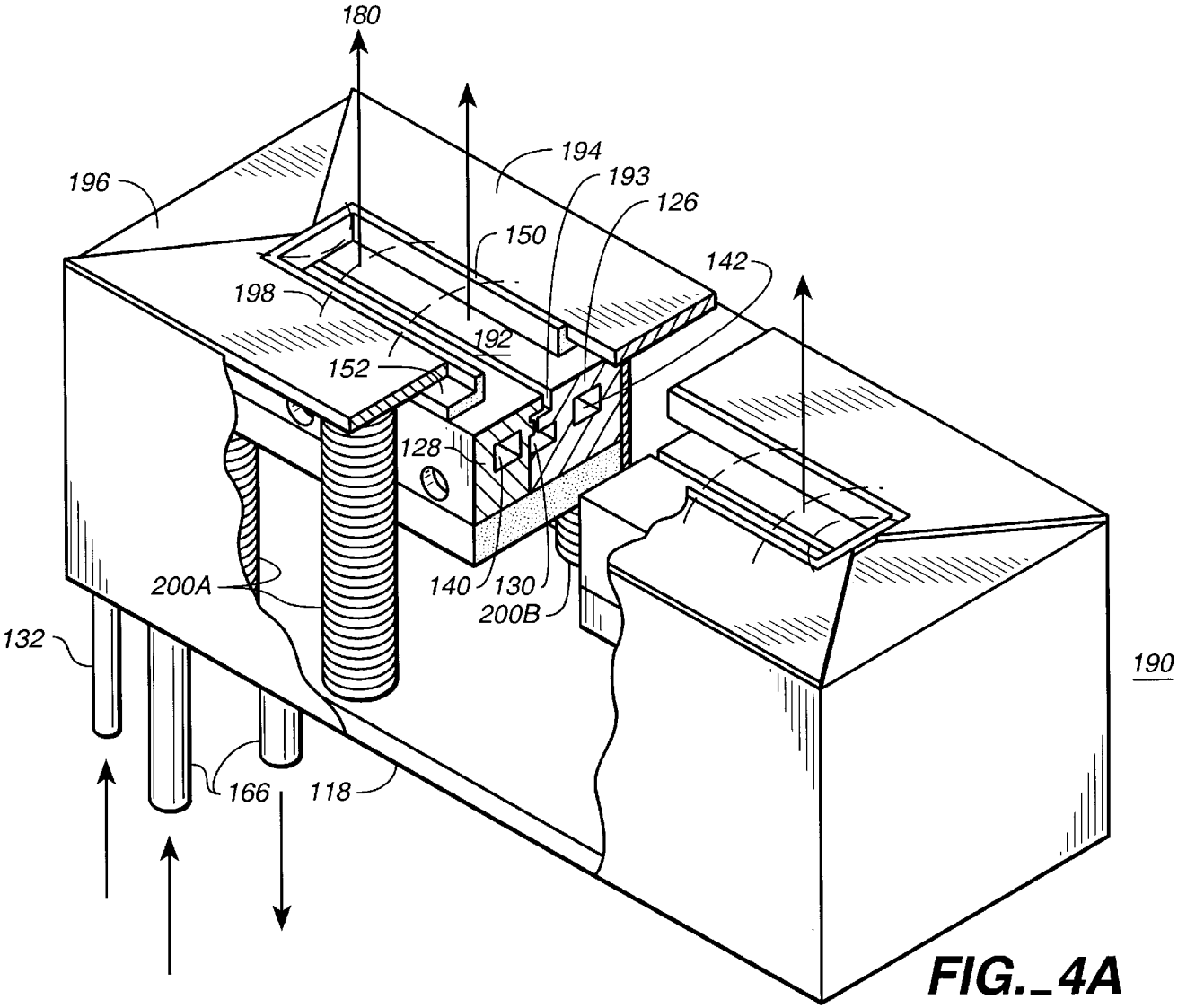
FIG. 4A is partial cross-sectional isometric view of another embodiment of the ion source apparatus of the present invention including a linear Hall-Current ion source assembly with a non-closed anode discharge region.
Figure 4B:
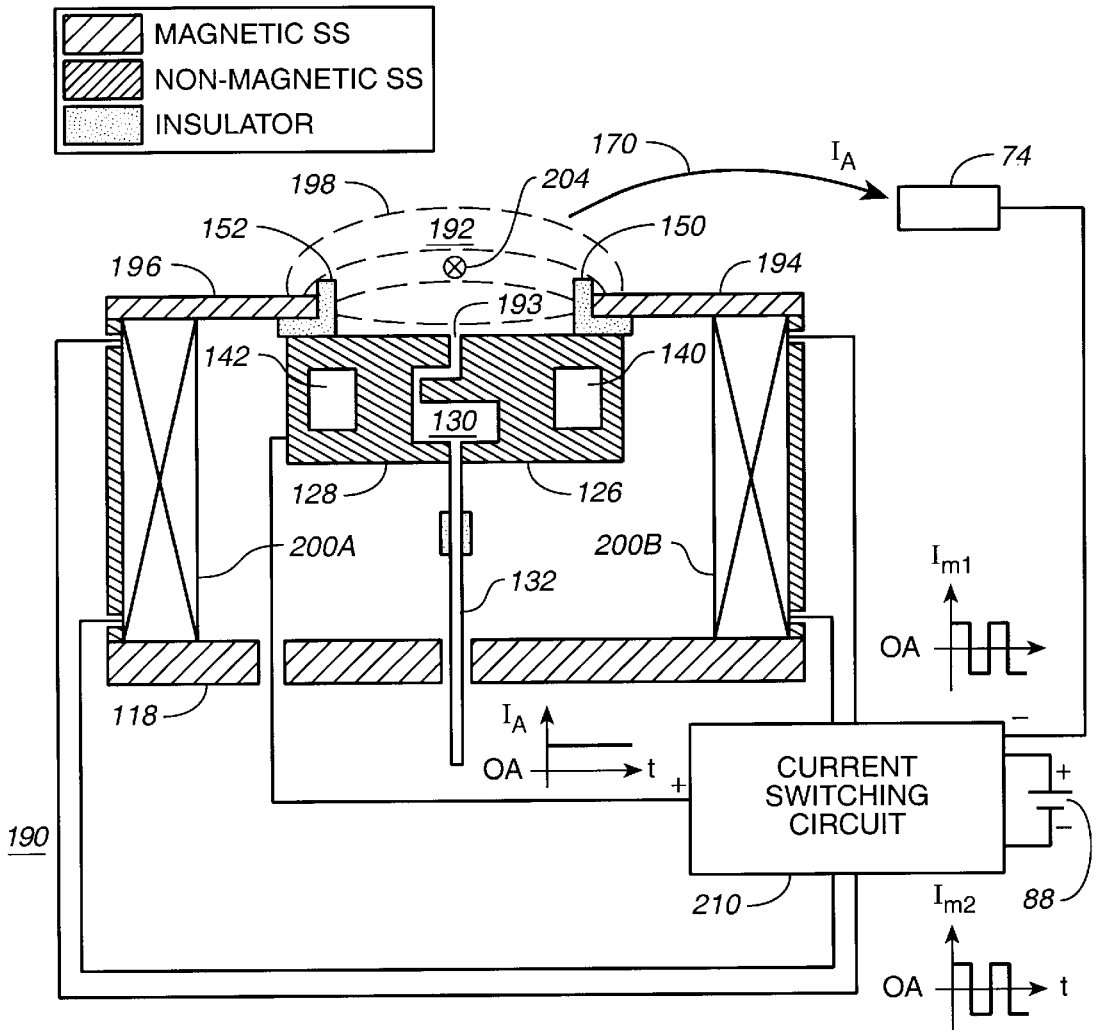
FIG. 4B is a diagrammatic cross-sectional view of the linear Hall-Current ion source assembly shown in FIG. 4A showing the physical dynamics.

All Hall-Current ion sources of the prior art make use of a closed path or channel for the anode discharge region. This has been done in order to avoid Hall-potentials that would occur if Hall-Current were not allowed to flow in a closed path and which would manifest non-uniformities or asymmetries in the plasma beam. FIGS. 4A and 4B depict a Hall-Current ion source of the present invention that incorporates all of the elements having the same reference number to those shown in ion source 70 depicted in FIG. 2 with the exceptions noted below. In the embodiment shown in FIGS. 4A and 4B, ion source 190 has a non-closed Hall-effect drift current path configuration and is uniquely operated in a manner to avoid the effects of the Hall-potential. Ion source 190 has a linear anode discharge region 192 to form linear gap 193 with cross sectional features similar to its the circular counter part shown in FIG. 2. Pole pieces 194 and 196 impart a magnetic field 198 across region 192 when the current is driven through electromagnets 200A and 200B. These same pole pieces may be designed to form magnetic cusp fields at the ends of linear region 192. In order to eliminate the asymmetric effect of Hall-potentials along region 192, this embodiment of the present invention uses a reversing means by which to periodically alternate or reverse the polarity of magnetic field 198 in time. By alternating the magnetic field, the direction of the Hall-current 204 along the closed path in region 192 is periodically reversed. The time-averaged result is a Hall-Current ion source whose discharge and plasma beam properties are substantially symmetric and uniform with respect to the length and scale of the linear anode discharge region 192.

One means of alternating magnetic field 198 is accomplished by a using a separate and independent electromagnet current supply which supplies a periodic current wave form. Another means of alternating field 198 is current switching circuit 210, shown in FIG. 4B, which is fed by a periodic signal to distribute and switch the direction of discharge current 170 to electromagnets 200A and 200B.

The Hall-Current ion source of the present invention is an advancement over the prior art because it combines several features that have not been previously embodied or taught as necessary for robust performance of ion beam processing, particularly for high power processing of temperature sensitive substrates.

The Hall-Current ion source of this invention differs from and is an improvement over the prior art in that it has a non-radiatively cooled anode assembly that is sealed against adjacent outer components that bound the anode discharge region. This enclosed or sealed anode configuration prevents the contraction of the active anode area to surface areas to the side or behind the anode during deposition of non-conductive coatings. Conversely, there are thin isolation gaps at the boundary of the anode assembly which prevent short circuits from developing to other electrically active surfaces in processes where conductive coatings are deposited. The sealed anode configuration limits the degree to which metal contaminants may be sputtered from the ion source surfaces and into the plasma beam. Moreover, the sealed anode configuration the inhibits formation of plasma along interfaces of the assembly of the anode discharge region and into the interior of the ion source. This, in turn, inhibits transient arcing between the anode and non-anode metal assembly parts within the interior of the ion source.

Also, the Hall-Current ion source of this invention differs from and is an improvement over the prior art in that gases are injected through the anode and by means of at least one shadowed-gap opening in the anode. This anode configuration serves to distribute the gas uniformly into the anode discharge region and provide a substantially uniform distribution of conductive surface area on the anode assembly. The combination of high current flux density to the shadowed-gap, purging neutral gas flow through the shadowed-gap, and the geometry of the shadowed-gap provides a robust means by which to operate a Hall-Current ion source during deposition of non-conductive coatings for prolonged periods of time as desired for production and without the shortcomings of the prior art.

The Hall-Current ion source of this invention additionally differs from and is an improvement over the prior art in that the electromagnet and the magnetic field in the acceleration channel are directly driven by or coupled to the ion source discharge current or driven by an AC current source. This method provides three advantages not discussed or taught in the prior art. (1) It allows easy and instant ignition of the ion source discharge over the entire continuously operable range of the device. (2) In the event that the discharge current is inadvertently disrupted of the main discharge current by some inadvertent transient arc or natural instability, the magnetic field drops in strength to decrease the impedance along the discharge current path to the anode. This rapid decrease in magnetic field and discharge impedance allows rapid re-ignition or self-regulated recovery of the ion source discharge with negligible disruption a process. (3) By connecting the electromagnet to the anode, it is possible to drive the discharge current to two anodes by a single power supply and a common cathode and, at the same time, split and regulate the power drawn to each anode discharge region. This property enables one to connect multiple Hall-Current ion source anodes in a wide variety of configurations (an array of anodes), to drive them with at least one power supply or power supply system, and to spatially control the properties of a distributed plasma beam from the array of anodes as may be required to process complex shaped or large area surfaces.

Figure 5:
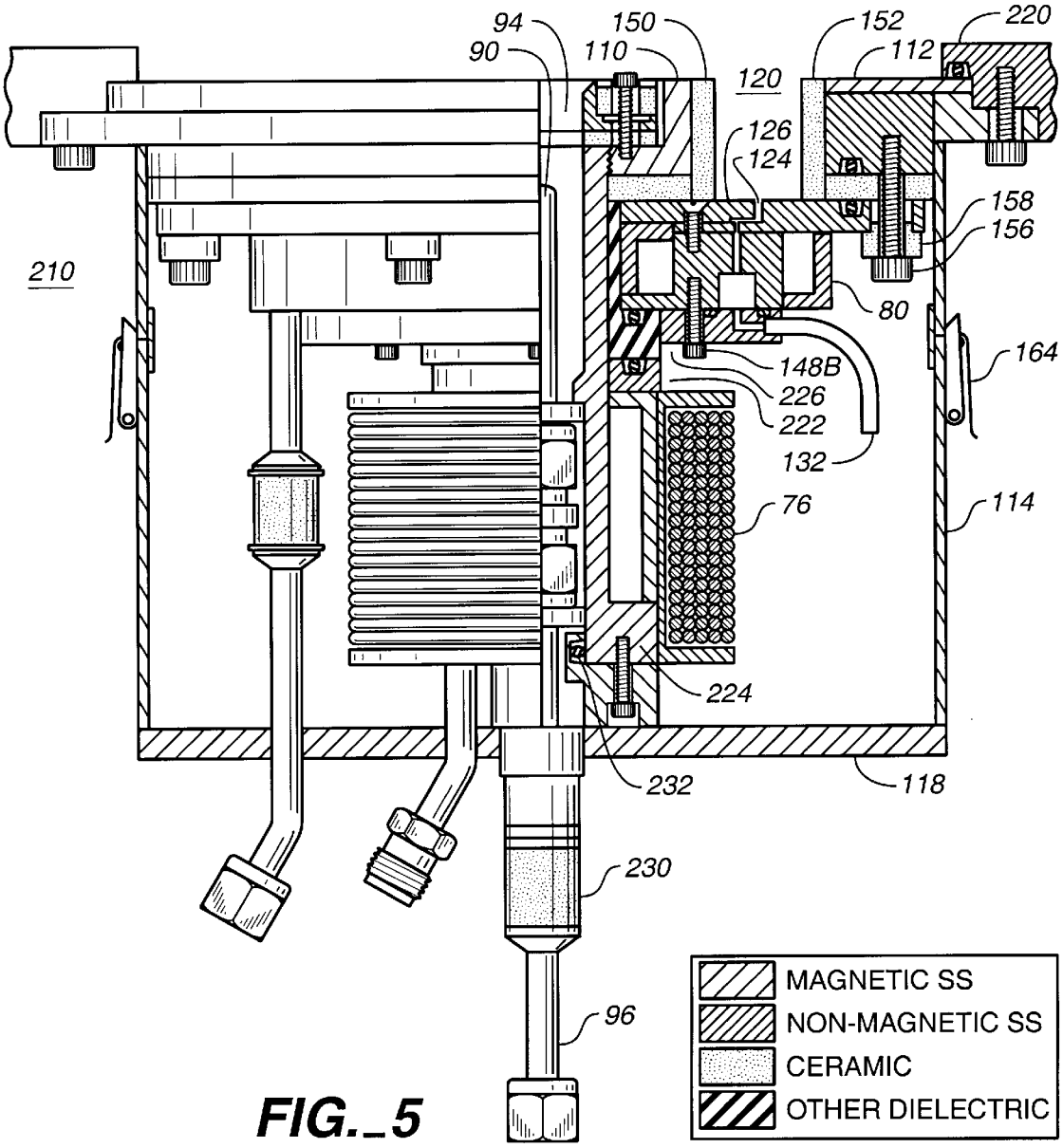
FIG. 5 is a diagrammatic cross-sectional view of another embodiment of the ion source apparatus of the present invention including a linear Hall-Current ion source and a self-sustaining cathode devised for vacuum flange mounting.

FIG. 5 depicts circular Hall-Current ion source 210 which is similar to ion source 70 shown in FIGS. 2 and 3A and is configured for mounting to a vacuum flange 220. The same reference numbers are used in FIG. 5 as used in FIGS. 2 and 3A for the components common to ion sources 70 and 210. Additional components for flange mounted ion source 210 include anode support ring 222 on water-cooled center pole 224 and dielectric bushing 226 to stand-off anode assembly 80 from center pole 224. O-rings are distributed within assembly 80 for flange mounting and vacuum service. FIG. 5 also shows how the hollow cathode electron source can be integrated into the water-cooled magnetic center pole 224 of the ion source. The hollow cathode has a hermetically sealed, electrically insulated, gas feedthrough 230 and O-ring seal 232.

The Hall-Current ion source arrangement depicted in FIG. 5 is particularly advantageous when treating circular or disk-shaped substrates positioned directly in front of the Hall-Current ion source. At such close proximity, an asymmetric placement of the cathode with respect to the plasma beam, as depicted in FIG. 2, can perturb the symmetry of the plasma beam. To achieve a high degree of beam symmetry and uniformity, it is helpful to position the cathode on vertical axis of ion source 210 as in shown in FIG. 5.

Figure 6:
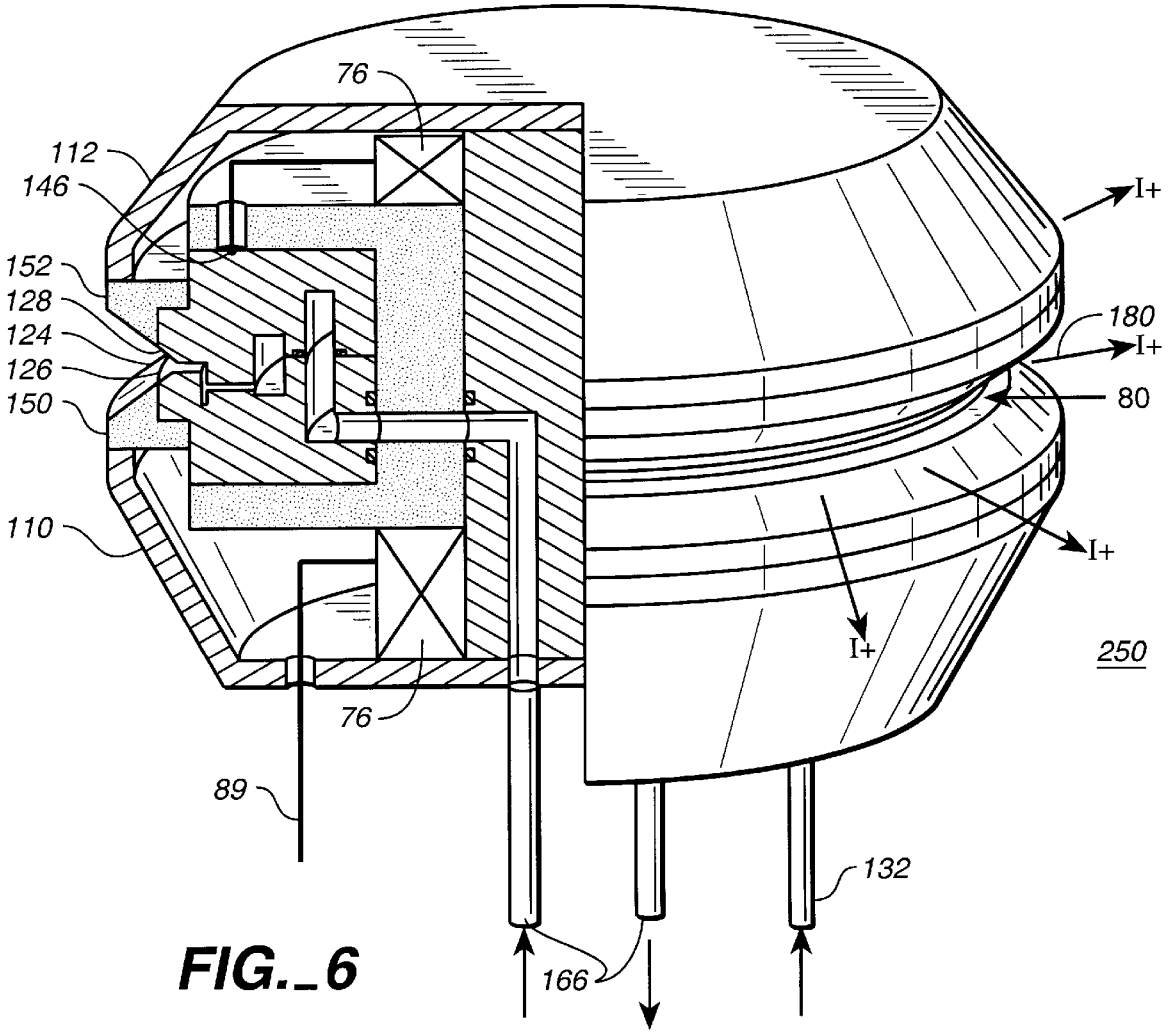
FIG. 6 is a partial cross-sectional isometric view of one embodiment of the ion source apparatus of the present invention including a Hall-Current ion source with a cylindrical anode assembly to produce a radially directed plasma beam.

FIG. 6 is a partial cutaway Hall-Current ion source 250 of the present invention with cylindrical anode assembly 80. The same reference numbers continue to be used in FIG. 6 as used in FIGS. 2 and 3A for the components common to ion sources 70 and 250. Although hollow cathode electron source 74 and power supply means 88 are not shown in FIG. 6, connection 89 can be connected to power supply means 88 as shown in FIGS. 2 and 3. The embodiment of FIG. 6 illustrates how the Hall-Current ion source can be geometrically configured to generate a radially directed plasma beam. Such an ion source or array of ion sources would be advantageous for depositing films and coatings within hollow forms, cylinders, or on to workpieces fixtured within a barrel shaped apparatus.

Furthermore, one skilled in the art can configure anode assemblies that embody the features depicted in FIGS. 2 and 3A, but which have uniquely a shaped closed or open Hall-effect drift current path(s) 178 and anode discharge region(s) or channel(s) 120. The shape of such channels include the cylindrical channels with closed circular gaps shown in FIGS. 2, 3A, 5, 6 and 7, and the non-closed linear channels and gaps shown in FIGS. 4A and 4B. The channels and corresponding gaps in the anode can also be oval, concave saddle, convex saddle, arc, or serpentine.

Figure 7:
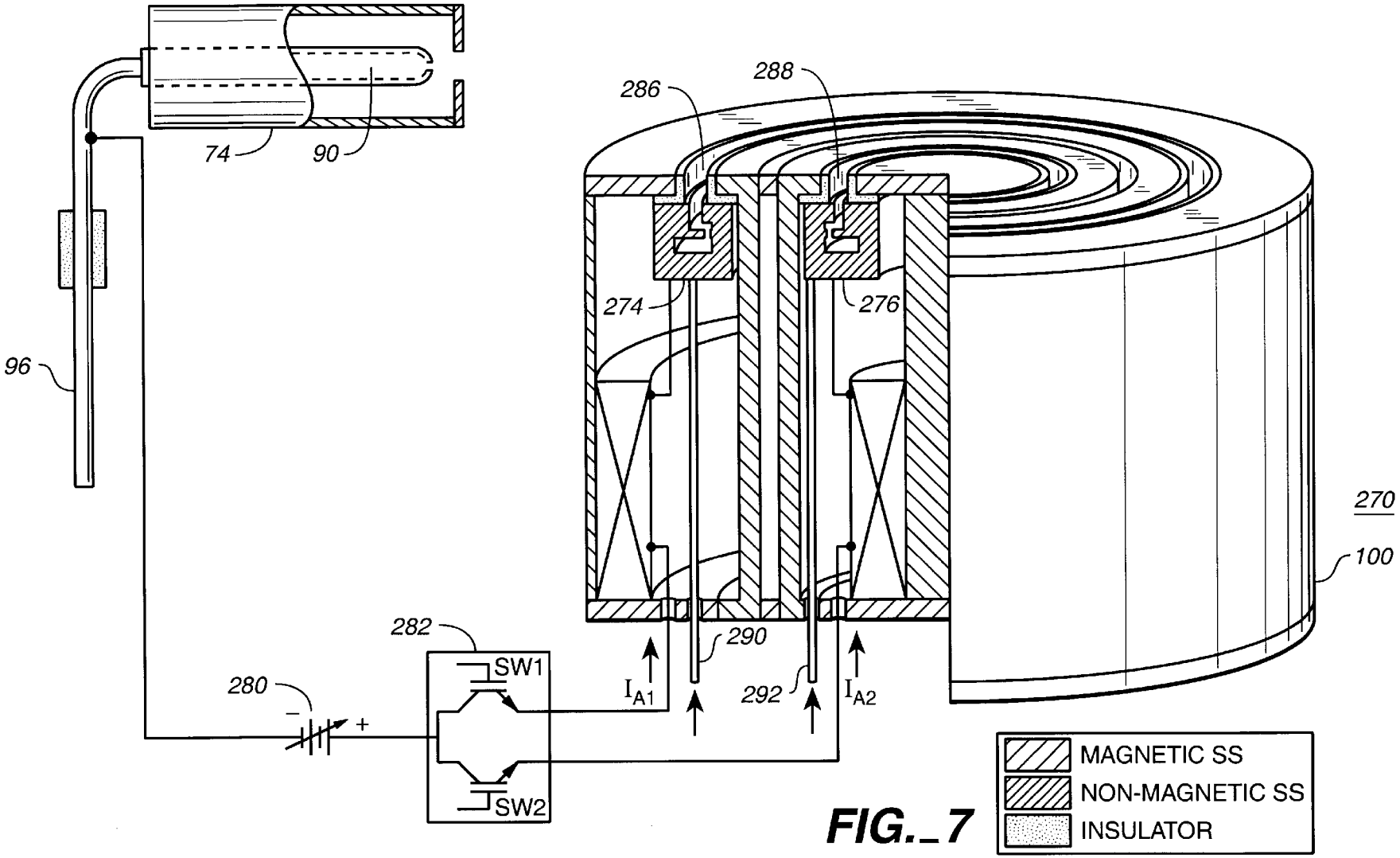
FIG. 7 is a partial cross-sectional isometric view of one embodiment of the ion source apparatus of the present invention including a Hall-Current ion source with a plurality of concentric anode assemblies and a self-sustaining cathode.

FIG.7 is a partial cut away of Hall-Current ion source 270 of the present invention having two closed concentric and circular anodes assemblies, both with features similar to those shown in FIGS. 2 and 3, with the same housing 100. The common hollow cathode assembly may be made separate or integrated into the ion source assembly as in FIG. 5. The two anode assemblies 274 and 276 are powered by a single power supply means 280 and a switching circuit 282. This switching circuit contains relays or solid state transistors SW1 and SW2 that may be controlled so as to dynamically distribute current (power) in various proportions between the anodes 274 and 276. While the switching network 282 shows control of current distribution to various anodes, two similar or complementary switching networks could be used to adjust tap points to the electromagnets and so as to alter the magnetic field strength across either anode discharge region 286 and 288 and thereby dynamically alter the power distributed to each anode. Also, similar or complementary control principles may be applied to the feed gas to each anode via feed lines 290 and 292. Moreover, current and/or voltage sense and control features could be adapted within the switching network to control inadvertent drifting of the power distributed to each anode. This particular Hall-Current ion source configuration and complementary power distribution networks are advantageous when it is desired to dynamically alter the scale or geometry of the ion beam or plasma profile in order to uniformly treat or deposit coatings onto work pieces in a manner that cannot be achieve with a Hall-Current source with a single anode.

Figure 8A:
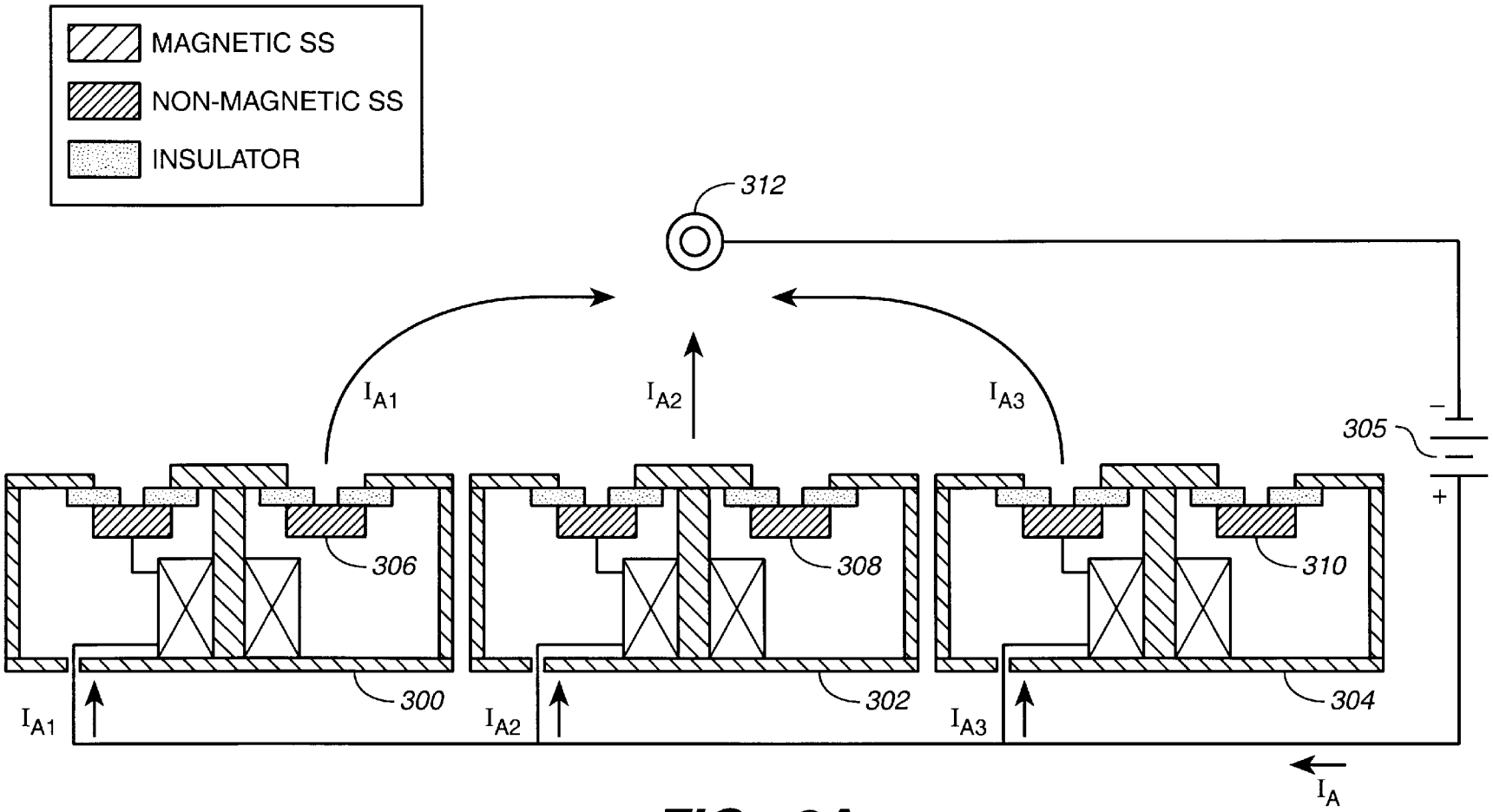
FIGS. 8A, 8B and 8C are schematic views of various electrical circuits used to connect and power an array of Hall-Current ion sources or a set of Hall-Current ion source anode assemblies of the present invention.
Figure 8B:
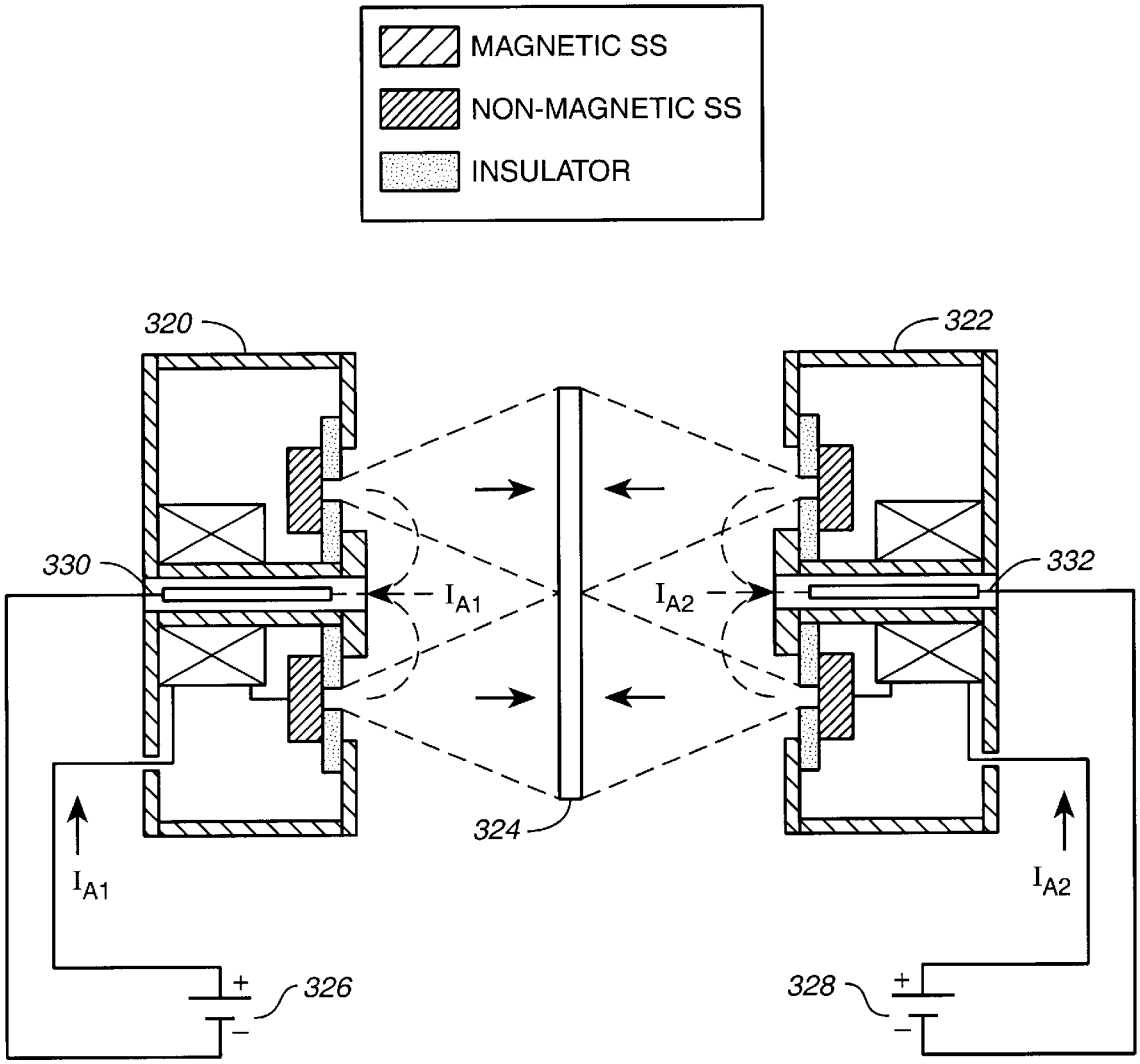
Figure 8C:
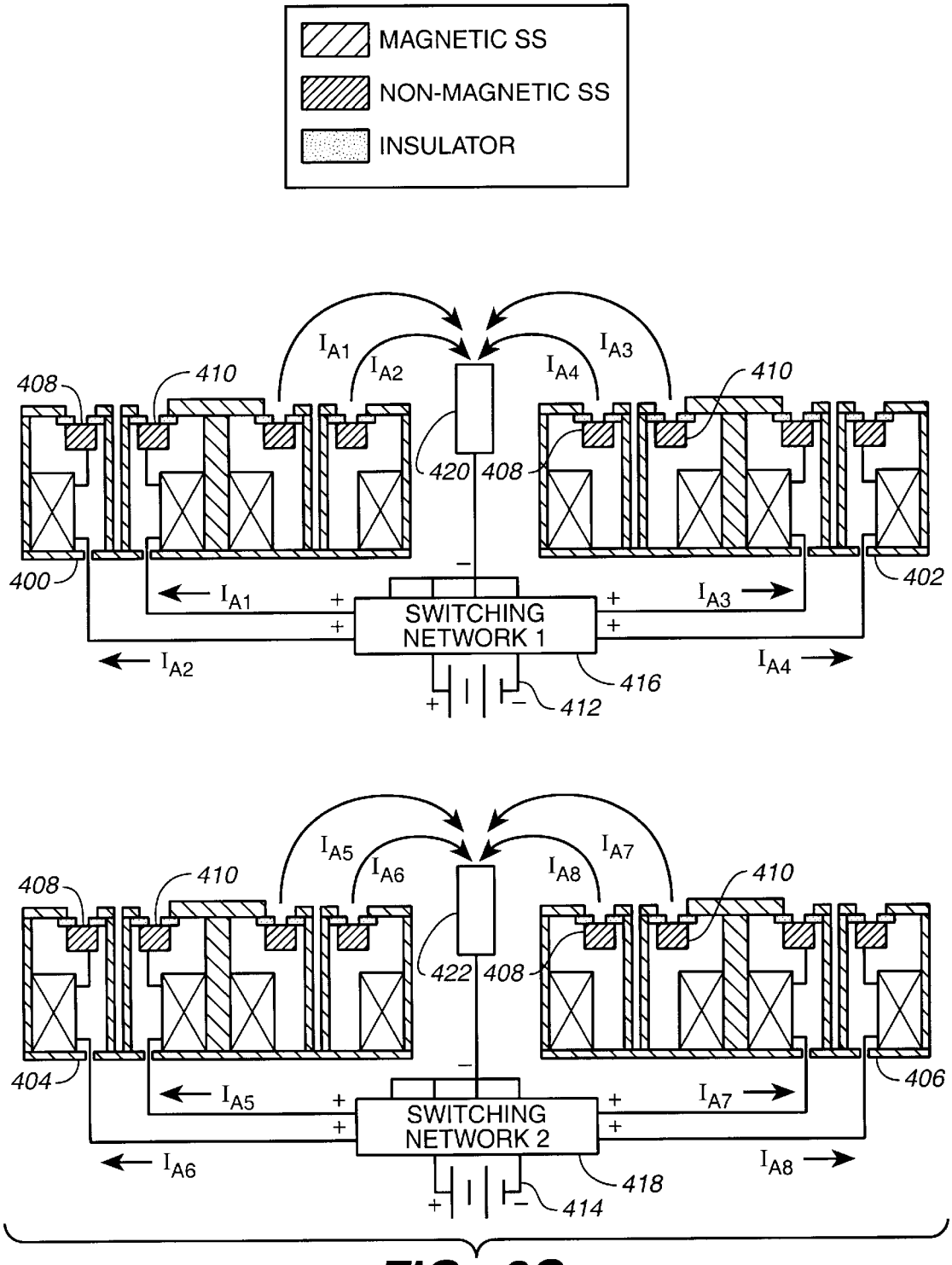

FIGS. 8A, 8B and 8C illustrate various electrical circuits used to connect and power an array of Hall-Current ion sources or a set of Hall-Current ion source anode assemblies. FIG. 8A shows an array of circular Hall-Current ion sources 300, 302 and 304 (circularly or linearly arranged) with the anodes connected in parallel and with a common cathode electron source. The closed-path Hall-Current ion sources depicted in FIGS. 8A–8C have features similar to those shown in FIGS. 2–3. However, it is understood that a similar ion source array could be constructed from any configuration of the Hall-Current ion source of the present invention including those shown in FIGS. 4A, 4B, 5, 6 or 7. In FIG. 8A, current $I_A$ from power supply 305 is split and distributed between multiple ion source anodes 306, 308, and 310. Currents $I_{A1}$, $I_{A2}$, and $I_{A3}$ are drawn to a common, self-sustained cathode 312 and returned to power supply 305. In the present case, power is divided passively between the Hall-Current ion source and is self-regulated by the impedance of each ion source in the array.

FIG. 8B illustrates two Hall-Current ion sources 320 and 322 with features similar to those of FIG. 5 which are arranged to treat both sides of workpiece 324. In this case, the Hall-Current ion sources are independently powered by power supplies 326 and 328 and each have their own self-sustained cathode 330 and 332. This dual-sided configuration is particularly useful in treating or coating both sides of substrate or fixture 324 simultaneously.

FIG. 8C shows a more complex Hall-Current ion source array that may be devised for treating large areas. The four Hall-Current ion sources, 400, 402, 404, and 406, each with two anode assemblies 408 and 410, have features similar to that shown in FIG. 7. The ion sources are powered by two separate power supplies 412 and 414 and two programmable current switching networks 416 and 418. Additionally, there are two common self-sustaining cathodes 420 and 422, each servicing four discharge current paths, $I_{A1}$ through $I_{A4}$ and $I_{A5}$ through $I_{A8}$, respectively. As with the ion source in FIG. 7, the power delivered to each anode discharge region may be dynamically regulated. Thus, the spatial distribution of the entire Hall-Current ion source array may be electronically adjusted to tailor its spatial beam characteristics and output. Similar electronic control schemes may be adapted to gas flows and tap points to electromagnets that are related to various anode discharge regions because gas flows and magnetic field values also strongly influence the electrical impedance of individual anode discharge regions.

EXAMPLES

The examples which follow illustrate the superior performance of the preferred embodiments of the Hall-Current ion source of the present invention. The examples are for illustrative purposes only and are not meant to limit the scope of the claims in any way.

In these examples, it is understood that all of the Hall-Current ion sources have the following common components:

(a) an ion source housing disposed within a deposition vacuum chamber;

(b) an anode assembly;

(c) a self-sustained cathode with its power supply(ies); and (d) an anode discharge power supply.

In all of the following examples, the workpieces were batch loaded into the deposition vacuum chamber. It is understood that in a production environment, the workpieces could be continuously loaded into the chamber by means of a load-lock means well known in the industry.

Examples A and B illustrate Hall-Current ion sources to help to distinguish the performance between a Hall-Current source of the present invention (Example B) from hose of the prior art (Example A) with regard to enabling the deposition of non-conductive coatings onto a workpiece. These examples particularly demonstrate the enabling principle of the self-shadowing gap on the anode.

Example A

This prior art example illustrates complications which arise when using a Hall-Current ion source of the prior art to deposit non-conductive coatings. The example particularly illustrates problems with conventional space-charge sheath Hall-Current ion sources depicted in FIG. 1B.

Figure 1B:
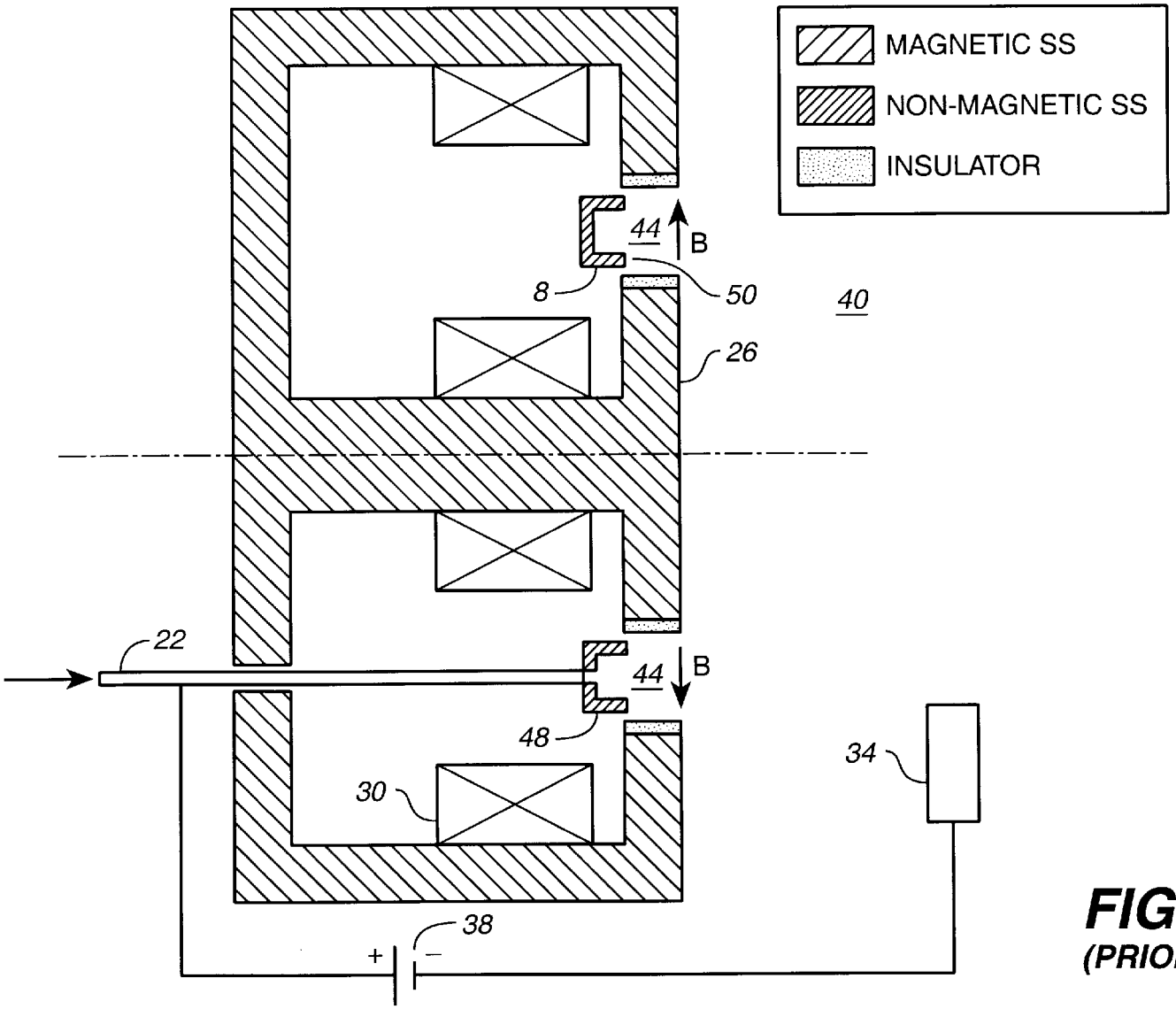
FIG. 1B (PRIOR ART)
FIG. 1B is a diagrammatic cross-sectional view of a space-charge sheath type (L/W<1) Hall-Current ion source.
Figure 1C:
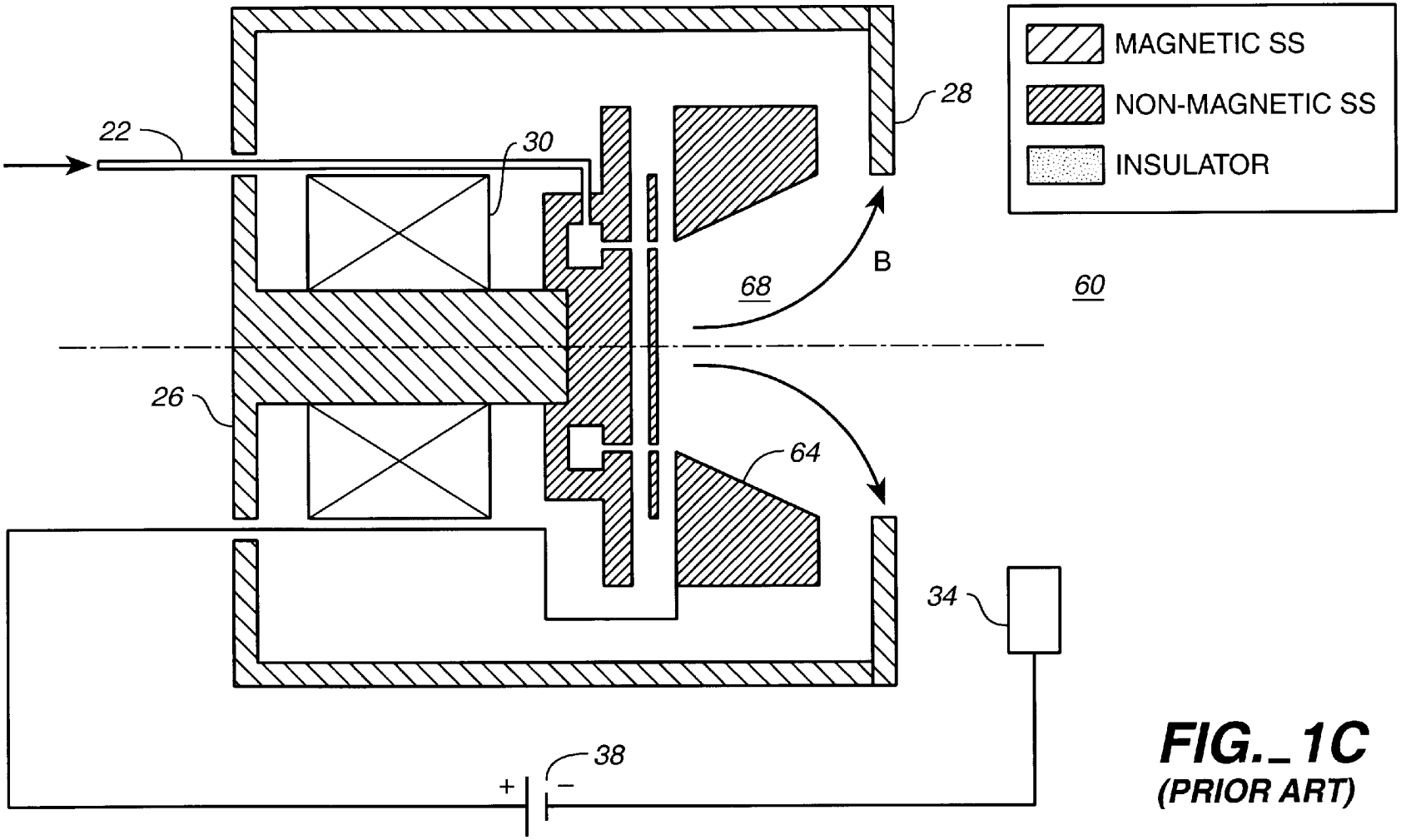
FIG. 1C (PRIOR ART)
FIG.1C is a diagrammatic cross-sectional view of an end-divergent magnetic field type of Hall-Current ion source.

A Hall-Current ion source similar to that in FIG. 1B was fabricated with a nominal 12.7 cm diameter by 1.75 cm wide, water-cooled, stainless-steel anode. The anode discharge region was surrounded by inner and outer alumina cylinders with a 0.3 cm gap between the anode edges and alumina cylinders. The anode was supported in the center of the anode discharge region by means of ceramic standoffs attached to a TEFLON™ covered back plate. The standoffs allowed the aspect ratio of the anode discharge region (L/W) to be adjusted up to about 2. In this example L/W was adjusted to about 1. Gas was introduced into the anode discharge region from behind the anode and around the edges of the anode. High-temperature ceramic braiding was wrapped around the inner and outer diameter of the anode in the 0.3 cm gaps to form a ceramic "sieve". This sieve was formed to distribute the gas somewhat evenly into the anode discharge region.

A magnetic field with near constant field strength and radial field lines running parallel to the anode face was formed by inner and outer cylindrical poles fabricated from cold-rolled steel and was driven by a single electromagnet disposed behind the anode assembly. The electromagnet was driven by an independent power supply. A 0.64 cm diameter stainless-steel, heated nozzle was located along the source axis at about 7.62 cm downstream from the face of the Hall-Current ion source to introduce deposition precursors into the plasma beam.

In summary, the Hall-Current ion source example of a prior art Hall-Current ion source comprised the following additional components:

(a) a partially sealed, closed-path, anode discharge region;

(b) a fluid-cooled anode;

(c) gas fed behind and around the anode; and (d) an electromagnet controlled by an independent DC power supply.

Prior to deposition operation, the source was successfully tested for stable operation in Ar and $O_2$ that was stable enough for testing deposition operation. (For high power Ar and $O_c$ operation, there was indication that a discharge would form behind the anode assembly.) Also, prior to this test, the anode had been cleaned of all non-conductive coatings.

To test deposition operation, the Hall-Current ion source was started with the electromagnet current, $I_M$, set at zero, 100 sccm of Ar, and 200 sccm of $O_2$ and an discharge current, $I_A$, set at 12 A. After ignition, $I_M$ was adjusted to impose a 170 Gauss (nominal) magnetic field in the center diameter of the anode discharge region at the anode face. A deposition precursor vapor, octamethylcyclotetrasiloxane (OMCTS), was then introduced at a variable flow rate between 10 and 40 sccm through the precursor nozzle, and the ion source gas was adjusted to 300 sccm of $O_2$. The vacuum pressure was then increased from 1.7 m Torr to 4 m Torr by means of a throttle valve at the pumping port to the vacuum chamber. The initial discharge voltage was 130 V and rose to 157 V over a 5 minute period after which time the ion source discharge self-extinguished. Several attempts were made to re-start the ion source by dropping $I_M$ to zero and re-setting the anode power supply, but with the given source configuration, it was not possible to sustain the ion source discharge for more than a few minutes.

Examination of the ion source after operation showed that the anode's forward surface had become coated with a non-conductive layer disrupting the discharge continuity to the anode. Also, it was observed that the discharge current had by-passed the ceramic sieve and to make contact to the non-coated backside of the anode near its exposed mechanical support hardware. The formation of this intense discharge activity behind the anode had melted parts of the support hardware and had damaged the alumina cylinders.

Example B

A Hall-Current ion source similar to that described in Example A was modified so that feed gases were delivered through a water-cooled copper anode by means of a gas manifold in the anode assembly and through the anode face by 20 equally spaced 0.079 cm diameter pin holes. A 0.478 cm thick copper gas deflection ring with about half the width of the anode ring was mounted directly to the anode face in order to shadow the 20 pin holes from line-of-sight deposition. Several small stainless-steel screws were used to mount the gas deflection ring to the anode. The deflection ring formed a 0.16 cm high by 0.71 cm wide annular gap devised to deflect the gas in a radially outward direction. The 0.3 cm annular gaps between the anode edges and the alumina walls were left open. The precursor nozzle was located on axis and 9.5 cm downstream from the face of the Hall-Current ion source.

In summary, the Hall-Current ion source in this example of the present invention comprised the following additional components:

(a) a partially sealed, closed-path, anode discharge region;

(b) a fluid-cooled anode;

(c) a self-shadowing gap on the anode at region of gas entry through the anode; and (d) an electromagnet controlled by an independent DC power supply.

Prior to deposition operation, the source was tested for stable operation in Ar and $O_2$. Also, prior to this test, the anode had been cleaned of all non-conductive coatings.

The Hall-Current ion source was started with $I_M$=0 A, 100 sccm of Ar and $I_A$=10 A. After ignition, the source was successfully operated at $I_A$=6A for over 60 minutes without failure at 2 m Torr with a 300 Gauss magnetic field, 200 sccm of $O_2$ through the anode, and 60 sccm of OMCTS through the precursor nozzle. The discharge voltage was typically about 176 V. Higher anode current levels could be run briefly, but not continuously as the high-profile stainless steel screws used to mount the shadowing gas deflection ring to the face of the anode would begin to overheat and draw current. After intentionally extinguishing the ion source discharge, the ion source could be re-started by decreasing $I_M$ to near 0 Amps.

Examination of the ion source after operation revealed that the exposed face and sides of the anode, the gas deflection ring and the stainless-steel hardware had all become coated with a non-conductive coating. However, those regions within the shadowed-gap at the face of the anode remained free of any substantial deposition and remained conductive. There was no evidence of any intense discharge activity (i.e., arcing) to the back side of the anode assembly, although undesirable diffusive discharge activity behind the anode clearly had been present.

The properties of the 8 $\mu$m coating deposited on the polycarbonate, silicon and quartz witness samples located 74 cm on-axis and downstream from the ion source were found to be similar to those reported in the Knapp et al., U.S. Pat. No. 5,508,368.

Examples C and D show how the use of an electromagnet driven in series with the anode discharge current enhances and extends the domain of operation of the Hall-Current ion source of the present invention.

Example C

A Hall-Current ion source of the present invention and similar to that depicted in FIG. 2 was fabricated and tested for stable operation with Ar and $O_2$ feed gases. The anode diameter was nominally 12 cm. A 16.5 cm diameter precursor injection ring located about 1.27 cm from the face of the ion source was constructed from a 0.64 inch diameter stainless-steel tube and fashioned with eight equally spaced 0.18 cm diameter holes to direct the precursor into the plasma beam.

In order to examine the ignition response of the ion source as it would behave during deposition or between deposition runs, the ion source anode was "seasoned" by operating in a depositing mode. In this instance, the ion source was then operated with 180 sccm of $O_2$, 45 sccm of tetramethylcyclotetrasiloxane (TMCTS) through the precursor injection ring and $I_A$=12 Amps for a period of about 30 minutes. During this seasoning step, the electromagnet was connected in series with the anode.

After seasoning the ion source anode, the ignition properties of the source were tested with the electromagnet driven by an independent current supply. The electromagnet was disconnected from the anode supply circuit and then re-connected to an independent power supply with an electromagnet current set point, $I_M$, adjusted to be equal to the discharge current set point, $I_A$.

In summary, the Hall-Current ion source in this example of the present invention comprised the following additional components:

(a) a sealed anode, closed-path, discharge region;

(b) a fluid-cooled anode;

(c) a self-shadowing gap on the anode at the region of gas entry through the anode; and (d) an electromagnet controlled by an independent DC power supply.

For this example, the peak anode voltage level at the anode supply was set to 300 V. Discharge ignition was tested in Ar (100 sccm and chamber pressure of 0.75 m Torr) and $O_2$ (180 sccm and chamber pressure of 1 m Torr) at $I_A$ and $I_M$ current set-points of 2, 5, 10 and 15 Amps. It was found that the discharge ignited immediately upon enabling the anode power supply for the Ar test cases wherein $I_M$ was pre-set at 2 and 5 Amps. However, for all other set points, discharge ignition did not occur immediately or would not occur at all with the anode supply set at 300 V. (A similar situation had been observed in the ion sources of Examples A and B). For many of the higher $I_M$ current level settings, it was necessary to increase the peak anode voltage setting between 350 and 500 V in order to exceed threshold anode potentials necessary to initiate breakdown and strike the discharge. In some instances, the discharge would ignite at the higher anode supply voltage settings, but would not achieve a sustained, steady-state condition, resulting in low frequency (0.1–1 Hz) periodic on-and-off oscillations of the discharge. Upon extinction, it would become necessary to decrease $I_M$ to near 0 Amps in order to decrease the threshold anode potential for breakdown and re-ignite the discharge.

It should be noted that in some instances, the Hall-Current ion source of this example would be very sensitive to "sparks" or "arclets", which could be induced by removing insulator 152 or 150 from the ion source assembly depicted in FIGS. 2 and 3. These 2 to 20 millisecond sparks or arclets would occur about the magnetic poles pieces near the anode discharge region and would effectively short the plasma in the anode discharge region to near-ground potentials. Often these transient events would trigger self-extinction of the discharge altogether. In a few other instances, the ion source appeared to be sensitive to its own non-linear properties that would be manifested in high-amplitude, periodic discharge current oscillations (about 2 to about 8 $A_{p-p}$ at 5 to 20 kHz). The ion source would sometimes self-extinguish when such large current oscillations were present.

Example D

The electromagnet of the Hall-Current ion source discussed in Example C was re-connected with the electromagnet in series with the anode discharge current as shown in FIG. 2. such that $I_M$ would equal $I_A$ at all times.

In summary, the Hall-Current ion source in this example of the present invention comprised the following additional components:

(a) a sealed, closed-path, anode discharge region;

(b) a fluid-cooled anode;

(c) a self-shadowing gap on the anode at the region of gas entry through the anode; and (d) an electromagnet driven by the anode-to-cathode discharge current.

For this example, the peak anode voltage level at the anode supply was set to 300 V. Anode discharge ignition was tested in Ar (100 sccm and chamber pressure of 0.75 m Torr) and $O_2$ (180 sccm and chamber pressure of 1 m Torr) at $I_A$ current set-points of 2, 5, 10 and 15 Amps. In all test cases, the discharge ignited easily and immediately after enabling the anode power supply. Anode threshold voltages typically ranged from 120 to 200 V. In this configuration, the undesirable and disabling low frequency, on-and-off oscillations and extinction scenarios noted in Example C were never witnessed, even when arclets and high current noise were induced or observed.

Examples E, F, G, H, and I illustrate the superior performance of the Hall-Current ion source of the preferred embodiment of the present invention when operating in accordance with the preferred method of the present invention specifically as they relate to the enclosed or sealed anode discharge region and means of introducing working gases through the shadowed-gap in the anode.

Example E

A Hall-Current ion source depicted in FIG. 2 and discussed in Example D was modified to bring the ion source outside the scope of the present invention by removing insulators 152 and gas connection 132. By this means, gases were introduced about from behind the anode, between parts 112 and 128, and into the anode discharge region 120.

In summary, the Hall-Current ion source in this example comprised the following additional components:

(a) a non-sealed, closed-path, anode discharge region;

(b) a fluid-cooled anode;

(c) gas fed from behind and around the anode; and (d) an electromagnet driven by the anode-to-cathode discharge current.

Prior to the deposition operation, the anode had been cleaned of all non-conductive coatings. The ion source was then operated with 180 sccm of $O_2$ through the ion source, 45 sccm of TMCTS through the precursor injection ring and with $I_A$=10 Amps. The discharge potential varied between 120 and 143 V.

Several failures occurred in the course of a 50 minute deposition period. As the anode became coated, the active part of the anode surface contracted to the outer edge of the anode between the gap defined by parts 112 and 128, thereby forcing intense discharge activity into the gap. Also, arclets, which appeared localized between the grounded outer pole 112 and outer anode ring 128, became more and more frequent (several arclets per second) in time. This undesirable migration of the discharge and plasma activity into the interior regions of the ion source caused other problems. The arcing activity sputtered metal from the underside of outer pole 112 and formed melted spots on the surface of anode ring 128. Damage also extended into the interior of the ion source. For example, the electrical connection 146 was discolored and the dielectric shielding of the anode feed wire had melted away electrically exposing the anode wire.

The wire had been corroded by the $O_2$ plasma that evidently had formed around this junction.

Example F

A Hall-Current ion source depicted in FIG. 2 and discussed in Example D was modified by replacing the outer anode ring 128 with one that did not have the shadowed-gap feature of the preferred embodiment of this invention and which exposed all 20 pin holes 136 directly to the anode discharge region 120 and not in accordance with the preferred method of this invention. Additionally in this example, 19 of the 20 pin holes were sealed. By this means, gases were introduced through only one hole in the anode.

In summary, the Hall-Current ion source in this example comprised the following additional components:

(a) a sealed, closed-path, anode discharge region;

(b) a fluid-cooled anode;

(c) gas fed through the anode surface at one exposed entry point; and (d) an electromagnet driven by the anode-to-cathode discharge current.

Prior to deposition operation, the anode was cleaned of all non-conductive coatings. The ion source was then operated with 180 sccm of $O_2$ through the ion source, 45 sccm of TMCTS through the precursor injection ring, and $I_A$=10 Amps.

Throughout the experiment, the discharge current at the anode was localized to the gas plume about the single open pin hole. The discharge current did not uniformly fill the annular anode discharge region and would not have been useful for coating static workpieces positioned at relatively short throw distances (10 to 30 cm). During the initial 15 minutes of operation the discharge voltage rose from 92 to 117 V as the anode became coated and the active anode area contracted to a region about the pin hole. Shortly thereafter, the discharge voltage dropped to 100 V and a bright glow was observed at the anode surface near the single pin hole.

After 27 minutes, the experiment was halted and the anode was inspected. All surfaces exposed to the anode discharge region were coated with a non-conductive layer accept a localized spot where the anode surface had melted a few millimeters away from the single pin hole and offset in clockwise direction of electron drift. The conductive spot was evidently caused by excessive heating of the anode surface by the intense electron contact current density (about 30 to 60 $A/cm^2$) that was localized to the small area near the gas feed. Such melting damaged the anode assembly and likely injected unwanted vaporized metal into the plasma beam. This example illustrates the need to distribute the discharge current density to a larger active surface area of the anode evenly distributed about the anode discharge region.

Example G

A Hall-Current ion source depicted in FIG. 2 and discussed in Example D was modified by replacing the outer anode ring 128 with a ring without the shadowed-gap feature of the preferred embodiment of this invention and which exposed pin holes 136 directly to the anode discharge region 120. In this example, all 20 pin holes were left open in accordance with the preferred embodiment.

In summary, the Hall-Current ion source in this example comprised the following additional components:

(a) a sealed, closed-path, anode discharge region;

(b) a fluid-cooled anode;

(c) gas fed through the anode surface at several (20) exposed and equally distributed entry points; and (d) an electromagnet driven by the anode-to-cathode discharge current.

Prior to the deposition operation, the anode was cleaned of all non-conductive coatings. The ion source then was operated with 180 sccm of $O_2$ through the ion source, 45 sccm of TMCTS through the precursor injection ring, and $I_A$=10 Amps.

During this experiment, the discharge voltage was initially 100 V and increased rapidly. Within a few minutes of deposition operation, intense, luminous discharge plumes formed about each of the 20 pin holes and the discharge potential increased to 180 V. Within 4 minutes, the discharge potential exceeded 200 V and arcing began to occur within and behind the ion source assembly along the electrical connections to the electromagnet and anode. At five minutes, the deposition experiment was terminated due to the arcing problem. Several attempts were then made to re-ignite the ion source in Ar and $O_2$ but with little success.

Subsequent inspection of the ion source showed that the entire surface of the anode exposed to the anode discharge region was coated with a non-conductive layer accept the inner surfaces of the 20 pin holes. The collective active anode area about the 20 pin holes had become so small that the anode potential needed to sustain the discharge current exceeded the design limits of the interior components of the ion source assembly. The example demonstrates that means of exposed, multiple gas injection points through the anode is susceptible to failure and can be disabling when depositing non-conductive coating without the shadowed-gap feature of the preferred embodiment of this invention.

Example H

A Hall-Current ion source depicted in FIG. 2 and discussed in Example D was successfully tested for stable operation in Ar and $O_2$ feed gases in accordance with preferred embodiment of this invention. Prior to deposition operation, the anode was cleaned of all non-conductive coatings. The ion source was then operated with 180 sccm of $O_2$ through the ion source, 45 sccm of TMCTS through the precursor injection ring, and $I_A$=12 Amps. The discharge potential rose from 106 V to a near steady-state value of 170 V over a 30 minute deposition period. As in Example D the ion source ran flawlessly and without interruption throughout the deposition period.

Example I

Two Hall-Current ion sources of the type depicted in FIG. 2 and discussed in Example D were installed in the same vacuum chamber and separated by about 30 cm. Each ion source was driven by its own hollow cathode electron source (HCES) and anode power supply. In this example, the deposition precursor was introduced by a liquid delivery system and through two heated nozzles as discussed in Example B. Prior to deposition operation, the anodes of both ion sources were cleaned of all non-conductive coatings. The ion sources were operated together each with 230 sccm of $O_2$ through the ion source, 15 grams/hour of OMCTS liquid (about 45 sccm of OMCTS vapor) through each heated vaporizer head and precursor nozzle, and $I_A$=12 Amps. Within the first 45 minutes of the deposition operation, the discharge potential of each ion source rose to near steady-state levels of 179 and 166 V. The ion sources continued to operate flawlessly throughout a 21.5 hour deposition period after which time the experiment was intentionally terminated. The final discharge potentials were 187 and 179 V, respectively.

Example J illustrates the use of two or more anodes connected in parallel to a common power supply and to at least one HCES in order to form Hall-Current ion source of the present invention comprised of an array of anode discharge regions.

Example J

Two Hall-Current ion sources of the type depicted in FIG. 2 and discussed in Example D were installed in the same vacuum chamber in close proximity to one another (about 20 cm spacing between the outer edged of each ion source assembly). A single anode supply was tied to the electromagnets of each ion source which were in turn connected to their respective anodes. The return of the anode supply was connected to a single HCES physically disposed between the two ion sources. In this configuration the anode currents would operate in parallel with return to the common HCES. The electromagnets were wired to form opposing clockwise and counter-clockwise electron drifts about each anode such that the discharge system would appear symmetric with respect to the HCES.

The dual-ion source system was operated with Ar flows to each ion source at 125 sccm and then at 75 sccm and with total discharge current level (split between the two anodes) of 5, 10, 15, and 20 Amps. For these conditions the discharge voltage for both ion sources ranged from 54 to 77 V. The current to each anode was split to within a 15% difference for all the current ranges studied. It was determined that one could compensate for any imbalance of discharge current or power delivered to the anodes operating in parallel by adjusting either the gas flow or amp-turns of the electromagnet to either of the two ion sources.

Examples K and L demonstrate a non-closed drift path Hall-Current ion source of the present invention and means to operate such an ion source through the use of a periodically alternating magnetic field.

Example K

A Hall-Current ion source depicted in FIG. 2 and discussed in Example D was modified by blocking off half of the annulus of the anode discharge region with a boron nitride insulator plate and end pieces. Also, ten of the twenty pin holes behind the boron nitride insulator were blocked. With this configuration, a semicircular, non-closed electron drift Hall-Current ion source was formed for testing.

In summary, the Hall-Current ion source in this example comprised the following additional components:

(a) a sealed, non-closed path, anode discharge region;

(b) a fluid-cooled anode;

(c) a self-shadowing gap on the anode at the region of gas entry through the anode; and (d) an electromagnet driven by the anode-to-cathode discharge current without periodic alternation of the current through the electromagnet.

Prior these tests the ion source anode had been seasoned with a non-conductive layer as described in Example C.

Initial testing indicated that the non-closed drift-path ion source was more difficult to ignite than its closed drift-path counterpart. After a glow discharge was formed in the anode discharge region, the glow would visually circulate clockwise in the direction of electron drift and then would often quickly extinguish at the end of the drift path. In those cases where the discharge was sustained, the glow discharge was dim at one side with increasing brightness in the clockwise electron drift direction. The asymmetric glow was indicative of the electron drift and the on-set of Hall-potentials along the anode discharge region.

Example L

A Hall-Current ion source discussed in Example K was modified by disconnected the electromagnet from anode supply circuit and re-connected to an independent AC (60 Hz) power supply. By this means, both the magnetic field and the electron drift direction were periodically altered in direction independently of the anode discharge current.

In summary, the Hall-Current ion source in this example comprised the following additional components:

(a) a sealed, non-closed path, anode discharge region;

(b) a fluid-cooled anode;

(c) a self-shadowing gap on the anode at the region of gas entry through the anode; and (d) an electromagnet driven by a periodically alternating current.

In contrast to the ion source configuration discussed in Example K, the non-closed drift-path ion source with periodically reversing magnetic field was far more easier to ignite and sustain. This was in part due to the fact that twice in the AC magnetic field cycle, the magnetic field and threshold voltage for discharge ignition would be minimized, allowing for easy ignition or periodic re-ignition about every 83 msec. Also, the visual appearance of the glowing discharge along the anode discharge region was uniform, indicating that the time-averaged Hall-potentials along the drift path had been either smoothed out or made symmetric with respect to the shape and scale of the Hall-Current ion source.

Without departing from the spirit and scope of this invention, one of ordinary skill in the art can make various changes and modification to the invention to adapt it to various usages and conditions. As such these changes and modifications are properly, equitably, and intended to be, within the full range of equivalents of the following claims.

What is claimed is:

1. A gridless ion source for the vacuum processing of materials comprising:

(a) a housing;

(b) at least one anode discharge region within said housing for the formation and acceleration of a plasma beam, said anode discharge region having an opening at a first end adjacent the exterior of said housing and at least one anode at a second end having at least one gap therein, said anode being electrically insulated from said housing in such a manner to prohibit the formation of plasma migrating into the interior of said housing behind said anode;

(c) cooling means for thermally cooling said anode other than by radiative thermal emission;

(d) at least one self-sustaining cathode;

(e) power supply means connected to said anode for supplying a voltage between said anode and said cathode for the breakdown of working gases to form a gaseous discharge and to drive an anode discharge current from said anode through said anode discharge region to said cathode;

(f) injection means for introducing the working gases through the gap in said anode and into said anode discharge region; and (g) electromagnetic means mounted in said housing for establishing and for at least partially driving a magnetic field within said anode discharge region.

2. An ion source as defined in claim 1 wherein said anode discharge region and the magnetic field are so disposed to allow the formation of a closed Hall-effect drift current path driven by means of a Hall-effect force within said anode discharge region.

3. An ion source as defined in claim 2 wherein the anode discharge current flowing between said anode and said cathode at least partially drives said electromagnetic means.

4. An ion source as defined in claim 1 including alternating current circuit means for periodically reversing the direction of the lines of flux of the magnetic field of said electromagnetic means.

5. An ion source as defined in claim 2 wherein the direction of the lines of flux of the magnetic field established by said electromagnetic means are substantially parallel to the surface of said anode at the second end of said anode discharge region.

6. An ion source as defined in claim 2 wherein the direction of the lines of flux of the magnetic field established by said electromagnetic means diverge in a direction substantially the same as that of the plasma beam exiting said anode discharge region.

7. An ion source as defined in claim 2 wherein said discharge region and the gap in said anode is substantially circular and said anode discharge region forms a plasma beam that is directed substantially axially outward with respect to the opening of said anode discharge region.

8. An ion source as defined in claim 2 wherein said discharge region and the gap in said anode is substantially rectangular and said anode discharge region forms a plasma beam that is directed substantially axially outward with respect to the opening of said anode discharge region.

9. An ion source as defined in claim 2 wherein said discharge region and the gap in said anode is substantially circular or rectangular and said anode discharge region forms a plasma beam that is directed substantially radially outward with respect to the opening of said anode discharge region.

10. An ion source as defined in claim 2 wherein said cathode is disposed axi-symmetrically with respect to said anode discharge region.

11. An ion source as defined in claim 2 wherein said cooling means comprises an injector means for directly contacting said anode with a cooling fluid.

12. An ion source as defined in claim 2 wherein said injection means having holes or gaps for substantially uniformly distributing the working gases into said anode discharge region and for substantially uniformly distributing the resulting anode discharge current adjacent to the gap.

13. An ion source as defined in claim 2 wherein said electromagnetic means comprises an electromagnetic combined with a material selected from the group consisting of permanent magnets, ferromagnetics, and magnets having a permeability greater than unity are combined for establishing the magnetic field and shaping the direction and strength of the magnetic field within said anode discharge region.

14. An ion source as defined in claim 2 for depositing materials onto substrates wherein the dimensions of the gap within said anode being at least greater than the characteristic Debye length of the local plasma formed near the gap in said anode and the shape of the gap being configured so as to substantially restrict line-of-sight deposition of coating onto said anode within said gap such that said anode discharge current is substantially maintained at said anode within the gap near a localized region of the working gases passing into said anode discharge region.

15. An ion source as defined in claim 14 wherein a distributor means is included in said housing for introducing deposition gases directly into the plasma beam and separately from that of said injection means for introducing working gases through the gap.

16. An ion source as defined in claim 15 wherein said distributor means comprises at least one tube having a nozzle at one end for directing the deposition gases into said anode discharge region.

17. An ion source as defined in claim 15 wherein said distributor means comprises at least one distributor ring for directing the deposition gas into said anode discharge region.

18. An ion source as defined in claim 15 wherein said distributor means comprises at least one tube having a nozzle at one end for directing the deposition gases outside said anode discharge region.

19. An ion source as defined in claim 15 wherein said distributor means comprises at least one distributor ring for directing the deposition gases outside said anode discharge region.

20. An ion source as defined in claim 15 wherein the deposition gases are selected from the group consisting of a hydrocarbon, siloxane, silazane, silane and mixtures thereof.

21. An ion source as defined in claim 2 is combined with at least an additional ion source to form an array of ion sources to process large area workpieces.

22. An ion source as defined in claim 2 is combined with at least an additional ion source to process at least two sides of a single workpiece.

23. An ion source as defined in claim 2 wherein at least two anode discharge regions are disposed within at least one housing and wherein the anode discharge current from said anode discharge regions share a common self-sustaining cathode.

24. An ion source as defined in claim 2 wherein said power supply means supplies a voltage selected from the group consisting of DC, AC, pulsed, RF voltage wave forms and combinations thereof.

25. An ion source as defined in claim 2 wherein said housing comprises metal walls and said anode is electrically insulated from said metal housing with a high temperature electrical insulator selected from the group consisting of alumina, aluminum nitride, quartz, boron nitride, glass-bonded mica, zirconia and mixtures thereof.

26. An ion source as defined in claim 3 wherein said electromagnetic means is connected in series with the anode discharge current and in the discharge current path between said anode and a positive lead of said power supply means.

27. An ion source as defined in claim 3 wherein said electromagnetic means is connected in series with the anode discharge current and in the discharge current path between said self-sustaining cathode and a negative lead of said power supply means.

28. An ion source as defined in claim 5 wherein the anode discharge current is periodically reversed through said electromagnetic means to periodically reverse the direction of the magnetic flux by a current switching circuit means.

29. An ion source as defined in claim 6 wherein the anode discharge current is periodically reversed through said electromagnetic means to periodically reverse the direction of the magnetic flux by a current switching circuit means.

30. An ion source as defined in claim 5 wherein the anode discharge current is periodically reversed through said electromagnetic means to periodically reverse the direction of the magnetic flux and to at least partially drive said electromagnetic means.

31. An ion source defined in claim 5 wherein said electromagnetic means is driven by a periodically reversing or alternating current supply means.

32. An ion source as defined in claim 6 wherein the anode discharge current is periodically reversed through said electromagnetic means to periodically reverse the direction of the magnetic flux and to at least partial drive said electromagnetic means.

33. An ion source defined in claim 6 wherein said electromagnetic means is driven by a periodically reversing or alternating current supply means.

34. A gridless ion source for the vacuum processing of materials comprising:

(a) a housing;

(b) at least one anode discharge region within said housing for the formation and acceleration of a plasma beam, said anode discharge region having an opening at a first end adjacent the exterior of said housing and at least one anode at a second end at least one gap therein, said anode being electrically insulated from said housing in such a manner to prohibit the formation of plasma migrating into the interior of said housing behind said anode;

(c) cooling means for thermally cooling said anode other than by radiative thermal emission;

(d) at least one self-sustaining cathode;

(e) power supply means connected to said anode for supplying a voltage between said anode and said cathode for the breakdown of working gases to form a gaseous discharge and to drive an anode discharge current from said anode through said anode discharge region to said cathode;

(f) injection means for introducing the working gases through the gap in said anode and into said anode discharge region; and (g) electromagnetic means mounted in said housing for establishing and for at least partially driving a magnetic field within said anode discharge region, wherein the direction of flux of said magnetic field is periodically reversed and wherein said anode discharge region and the magnetic field are so disposed to allow the formation of a non-closed Hall-effect electron drift current path driven by means of a Hall-effect force within said anode discharge region.

35. An ion source as defined in claim 34 wherein a separate power supply means supplying an AC voltage wave form drives said electromagnetic means and periodically reverses the direction of flux.

36. An ion source as defined in claim 34 wherein the anode discharge current is periodically reversed through said electromagnetic means to periodically reverse the direction of the flux by a current switching circuit means.

37. An ion source as defined in claim 34 with said anode discharge region forming a channel to produce a plasma beam that substantially is directed axially outward with respect to said ion source and with the magnetic field at the ends of said channel forming a cusp extending inwardly towards said anode discharge region.

38. An ion source as defined in claim 34 wherein the direction of the lines of flux of the magnetic field established by said electromagnetic means are substantially parallel to the surface of said anode at the second end of said anode discharge region.

39. An ion source as defined in claim 34 wherein the direction of the lines of flux of the magnetic field established by said electromagnetic means diverge in a direction substantially the same as that of the plasma beam exiting said anode discharge region.

40. An ion source as defined in claim 34 wherein said discharge region and the gap in said anode is substantially circular and said anode discharge region forms a plasma beam that is directed substantially axially outward with respect to the opening of said anode discharge region.

41. An ion source as defined in claim 34 wherein said discharge region and the gap in said anode is substantially linear and said anode discharge region forms a plasma beam that is directed substantially axially outward with respect to the opening of said anode discharge region.

42. An ion source as defined in claim 34 wherein said discharge region and the gap in said anode is substantially circular or linear and said anode discharge region forms a plasma beam that is directed substantially radially outward with respect to the opening of said anode discharge region.

43. An ion source as defined in claim 34 wherein said cathode is disposed axi-symmetrically with respect to said anode discharge region.

44. An ion source as defined in claim 34 wherein said cooling means comprises an injector means for directly contacting said anode with a cooling fluid.

45. An ion source as defined in claim 34 wherein said injection means having holes or gaps for substantially uniformly distributing the working gases into said anode discharge region and for substantially uniformly distributing the resulting anode discharge current adjacent to the gap.

46. An ion source as defined in claim 34 wherein said housing comprises metal walls and said anode is electrically insulated from said metal housing with a high temperature electrical insulator selected from the group consisting of alumina, aluminum nitride, quartz, boron nitride, glass-bonded mica, zirconia and mixtures thereof.

47. An ion source as defined in claim 34 wherein said electromagnetic means comprises an electromagnetic combined with a material selected from the group consisting of permanent magnets, ferromagnetics, and magnets having a permeability greater than unity are combined for establishing the magnetic field and shaping the direction and strength of the magnetic field within said anode discharge region.

48. An ion source as defined in claim 34 for depositing materials onto substrates wherein the dimensions of the gap within said anode being at least greater than the characteristic Debye length of the local plasma formed near the gap in said anode and the shape of the gap being configured so as to substantially restrict line-of-sight deposition of coating onto said anode within said gap such that said anode discharge current is substantially maintained at said anode within the gap near a localized region of the working gases passing into said anode discharge region.

49. An ion source as defined in claim 48 wherein a distributor means is included in said housing for introducing deposition gases directly into the plasma beam and separately from that of said injection means for introducing working gases through the gap.

50. An ion source as defined in claim 49 wherein said distributor means comprises at least one tube having a nozzle at one end for directing the deposition gases into said anode discharge region.

51. An ion source as defined in claim 49 wherein said distributor means comprises at least one distributor ring for directing the deposition gas into said anode discharge region.

52. An ion source as defined in claim 49 wherein said distributor means comprises at least one tube having a nozzle at one end for directing the deposition gases outside said anode discharge region.

53. An ion source as defined in claim 49 wherein said distributor means comprises at least one distributor ring for directing the deposition gases outside said anode discharge region.

54. An ion source as defined in claim 49 wherein the deposition gases are selected from the group consisting of a hydrocarbon, siloxane, silazane, silane and mixtures thereof.

55. An ion source as defined in claim 34 is combined with at least an additional ion source to form an array of ion sources to process large area workpieces.

56. An ion source as defined in claim 34 is combined with at least an additional ion source to process at least two sides of a single workpiece.

57. An ion source as defined in claim 34 wherein at least two anode discharge regions are disposed within at least one housing and wherein the anode discharge current from said anode discharge regions share a common self-sustaining cathode.

58. An ion source as defined in claim 34 wherein said power supply means supplies a voltage selected from the group consisting of DC, AC, pulsed, RF voltage wave forms and combinations thereof.

59. An ion source as defined in claim 34 wherein said electromagnetic means is connected in series with the anode discharge current and in the discharge current path between said anode and a positive lead of said power supply means.

60. An ion source as defined in claim 36 wherein said electromagnetic means is connected in series with the anode discharge current and in the discharge current path between said self-sustaining cathode and a negative lead of said power supply means.

61. An ion source as defined in claim 36 wherein said electromagnet in series with the anode discharge current and in said discharge current path between said anode and positive lead of a power supply for said voltage and means of establishing said periodic wave form with an electronic current switching network so disposed to alter the current direction or amplitude or combination thereof within said electromagnet.

62. A gridless ion source for the deposition of materials onto substrates comprising:

(a) a housing;

(b) at least one anode discharge region within said housing for the formation and acceleration of a plasma beam, said anode discharge region having an opening at a first end adjacent the exterior of said housing and at least one anode at a second end, said anode being electrically insulated from said housing in such a manner to prohibit the formation of plasma migrating into the interior of said housing behind said anode;

(c) cooling means for thermally cooling said anode other than by radiative thermal emission;

(d) at least one self-sustaining cathode disposed outside anode discharge region and substantially outside the plasma beam;

(e) power supply means connected to said anode for supplying a voltage between said anode and said cathode for the breakdown of working gases to form a gaseous discharge and to drive a anode discharge current from said anode through said anode discharge region to said cathode;

(f) injection means for introducing the working gases through at least one gap within said anode and into said anode discharge region, the dimensions of the gap within said anode being at least greater than the characteristic Debye length of the local plasma formed near the gap in said anode and the shape of the gap being configured so as to substantially restrict line-of-sight deposition of coating onto said anode within said gap such that said anode discharge current is substantially maintained at said anode within the gap near a localized region of the working gases passing into said anode discharge region; and (g) electromagnetic means mounted in said housing for establishing and for at least partially driving a magnetic field within said anode discharge region, wherein the direction of flux of said magnetic field is periodically reversed and wherein said anode discharge region and the magnetic field are so disposed to allow the formation of a non-closed Hall-effect electron drift current path driven by means of a Hall-effect force within said anode discharge region.

63. A gridless ion source for the vacuum processing of materials comprising:

(a) a housing;

(b) at least one anode discharge region within said housing for the formation and acceleration of a plasma beam, said anode discharge region having an opening at a first end adjacent the exterior of said housing and at least one anode at a second end having at least one gap therein, said anode being electrically insulated from said housing in such a manner to prohibit the formation of plasma migrating into the interior of said housing behind said anode;

(c) cooling means for thermally cooling said anode other than by radiative thermal emission;

(d) at least one self-sustaining cathode;

(e) power supply means connected to said anode for supplying a voltage between said anode and said cathode for the breakdown of working gases to form a gaseous discharge and to drive an anode discharge current from said anode through said anode discharge region to said cathode;

(f) injection means for introducing the working gases through at least one gap within said anode and into said anode discharge region; the dimensions of the gap within said anode being at least greater than the characteristic Debye length of the local plasma formed near the gap in said anode and the shape of the gap being configured so as to substantially restrict line-of-sight deposition of coating onto said anode within said gap such that said anode discharge current is substantially maintained at said anode within the gap near a localized region of the working gases passing into said anode discharge region;

(g) electromagnetic means mounted in said housing for establishing and for at least partially driving a magnetic field within said anode discharge region.

(h) at least one electrically isolating gap between said anode and an adjacent portion of said housing bounding said anode discharge region disposed in such a manner to prohibit formation of conductive paths within said electrically isolating gap and between said anode and said adjacent portion of said housing.

64. An ion source as defined in claim 63 wherein said electrically isolating gap is purged with a non-depositing working gas.

* * * * *